US006336770B1

(12) United States Patent
Evans

(10) Patent No.: US 6,336,770 B1
(45) **Date of Patent: *Jan. 8, 2002**

(54) DRAINFIELD PIPE INSTALLATION DEVICE

(76) Inventor: Kelvin Todd Evans, 440 W. New York Ave., Orange City, FL (US) 32763

( * ) Notice: Subject to any disclaimer, the term of this patent is extended or adjusted under 35 U.S.C. 154(b) by 0 days.

This patent is subject to a terminal disclaimer.

(21) Appl. No.: 09/531,619

(22) Filed: Mar. 21, 2000

Related U.S. Application Data

(63) Continuation-in-part of application No. 09/176,520, filed on Oct. 21, 1998, now Pat. No. 6,120,209, which is a continuation of application No. 08/703,827, filed on Aug. 27, 1996, now Pat. No. 5,829,916, which is a continuation-in-part of application No. 08/464,971, filed on Jun. 5, 1995, now Pat. No. 5,549,415.

(51) Int. Cl.[7] ..... E02B 13/00

(52) U.S. Cl. ..... 405/43; 405/49; 405/128; 138/173

(58) Field of Search ..... 405/36, 43, 44, 405/49, 51, 128; 137/314, 386; 138/173

(56) References Cited

U.S. PATENT DOCUMENTS

| | | | |
|---|---|---|---|
| D31,429 | S | 8/1899 | Love |
| 1,060,870 | A | 5/1913 | Wiley |
| 1,169,689 | A | 1/1916 | Smith |
| 1,596,418 | A | 8/1926 | Evans |
| 2,091,265 | A | 8/1937 | Brown |
| 3,060,693 | A | 10/1962 | Taylor |
| 3,403,519 | A | 10/1968 | Balko |
| 3,441,140 | A | 4/1969 | Thurber |
| 3,446,025 | A | 5/1969 | Koch |
| 3,451,136 | A | 6/1969 | Shuttle |
| 3,568,455 | A | 3/1971 | McLaughlin et al. |
| 3,695,643 | A | 10/1972 | Schmunk |
| 3,714,786 | A | 2/1973 | Evans et al. |
| 3,823,825 | A | 7/1974 | Bergles et al. |
| 3,897,090 | A | 7/1975 | Maroschak |
| 4,006,599 | A | 2/1977 | Hegler et al. |
| 4,019,326 | A | 4/1977 | Herveling et al. |
| 4,043,139 | A | 8/1977 | Scott |
| 4,090,686 | A | 5/1978 | Yarbrough |
| 4,126,012 | A | 11/1978 | Waller |
| 4,140,422 | A | 2/1979 | Crumpler et al. |
| 4,163,619 | A | 8/1979 | Fales |

(List continued on next page.)

FOREIGN PATENT DOCUMENTS

| | | |
|---|---|---|
| DE | 1228469 | 11/1966 |
| WO | 8607124 | 12/1986 |

*Primary Examiner*—Roger Schoeppel
(74) *Attorney, Agent, or Firm*—Allen, Dyer, Doppelt, Milbrath & Gilchrist, P.A.

(57) ABSTRACT

A drainfield pipe having a rib radially extending from its wall is supported by a device which comprises opposing elongate anchor members having inside edges tapering away from a clamping end for sliding the drainfield pipe between the anchor members when the pipe is being positioned on the grade surface prior to supporting above the surface. The elongate anchor members penetrate a grade surface for holding the device upright while ta clamp is secured to the rib for holding the pipe above the grade surface. The clamp is attached to the anchor member upper portion and holds the rib between clamp jaws. In addition, the separation of the tapered edges proximate the clamp is such to position the edges between corrugation of the pipe. Supporting the pipe from the radially extending rib permits the pipe to be held at desired positions within an absorption area of a drainfield for introduction of aggregate into the absorption area without displacing interconnected pipe sections from their preset location. With the rib positioned upward and away from the drainfield surface, the support devices holding the pipe are removed after the aggregate is placed within the drainfield and around the pipe, and removed without displacing the pipe.

30 Claims, 19 Drawing Sheets

U.S. PATENT DOCUMENTS

| | | | |
|---|---|---|---|
| 4,182,581 | A | 1/1980 | Uehara et al. |
| 4,268,189 | A | 5/1981 | Good |
| 4,425,172 | A | 1/1984 | Schirmer |
| 4,588,325 | A | 5/1986 | Seefert |
| 4,681,684 | A | 7/1987 | Maroschak et al. |
| 4,878,781 | A | 11/1989 | Gregory et al. |
| 4,966,741 | A | 10/1990 | Rush et al. |
| 5,015,123 | A | 5/1991 | Houck et al. |
| 5,082,028 | A | 1/1992 | Jean-Jacques |
| 5,226,456 | A | 7/1993 | Semak |
| 5,242,247 | A | 9/1993 | Murphy |
| 5,383,314 | A | 1/1995 | Rothberg |
| 5,417,460 | A | 5/1995 | Lunder |
| 5,429,397 | A | 7/1995 | Kanao |
| 5,447,128 | A | 9/1995 | Spinelli |
| 5,549,415 | A | 8/1996 | Evans |
| 5,609,713 | A | 3/1997 | Kime et al. |

DRAINFIELD PIPE INSTALLATION DEVICE

CROSS REFERENCE TO RELATED APPLICATIONS

This application is a continuation-in-part application of application Ser. No. 09/176,520 filed Oct. 21, 1998 for "Drainfield Pipe Installation and Method" now U.S Pat. No. 6,120,209 which itself is a continuation of application Ser. No. 08/703,827 filed Aug. 27, 1996 for "Drainfield Pipe" issuing as U.S. Pat. No. 5,829,916, which itself is a continuation-in-part of application Ser. No. 08/464,971 filed Jun. 5, 1995 for "Septic Tank Drainfield Installation Device and Method" issuing as U.S. Pat. No. 5,549,415, all commonly owned with the present invention.

FIELD OF INVENTION

The invention relates to a method and device for the installation of on-site water treatment and sewage disposal systems, and in particular to installation of drainfield pipe.

BACKGROUND

As defined in the Florida Administrative Code, Rule 10 D-6, Department of Health and Rehabilitative Services, Standards for Onsite Sewage Treatment and Disposal Systems, onsite sewage treatment and disposal systems comprise a sewage treatment and disposal facility, that contains a standard subsurface, filled or mound drainfield system, an aerobic treatment unit, a grey water system tank, a laundry wastewater system tank, a septic tank, a grease interceptor, a dosing tank, a solids or effluent pump, waterless, incinerating or organic waste composting toilets, or a sanitary pit privy that is installed beyond a building sewer on land of the owner or on other land to which the owner has the legal right to install a system. As further defined in the above referenced Code, a drainfield comprises a system of open jointed or perforated piping, approved alternative distribution units, or other treatment facilities designed to distribute effluent for filtration, oxidation and absorption by the soil within the zone of aeration. Further defined in the Code, is a septic tank, which is a watertight receptacle constructed to promote separation of solid and liquid components of wastewater, to provide limited digestion of organic matter, to store solids, and to allow clarified liquid to discharge for further treatment and disposal into the drainfield.

Typically, drainfields are "standard subsurface systems", "filled systems", or "mound systems." The above referenced Code defines a standard subsurface drainfield system as an onsite sewage treatment and disposal system drainfield consisting of a distribution box or header pipe and a drain trench or absorption bed with all portions of the drainfield sidewalls installed below the elevation of undisturbed native soil. A filled system is defined as a drainfield system where a portion, but not all, of the drainfield sidewalls are located at an elevation above the elevation of undisturbed native soil on the site. Mound systems are defined as drainfields constructed at a prescribed elevation in a prepared area of fill material. All drainfields where any part of the bottom surface of the drainfield is located at or above the elevation of undisturbed native soil in the drainfield area is a mound system.

Drain trenches and absorption beds are the standard for drainfield systems used for disposing of effluent from septic tanks or other sewage waste receptacles. An absorption bed comprises an area in which the entire earth content to a specified depth in the required absorption area is removed, replaced with aggregate to that specified depth, and distribution pipe or other approved drainfield components. The distance between the centers of the distribution lines in standard beds is to be a maximum of 36 inches in order to meet the above referenced Code. Further, the distance between the side wall of the bed and the center of the outside drain is to be no more than 18 inches, but shall not be less than six inches. Header pipe is to extend to within 18 inches of the side walls. The maximum depth from the bottom of the drainfield to the finished ground surface shall not exceed 30 inches after natural settling. The minimum earth cover over the top of the drainfield, distribution box or header pipe in standard subsurface drainfields shall be 6 inches after natural settling. By way of example, depending on the type of drainfield system being utilized, the drainfield absorption surface is to be constructed level or with a downward slope not exceeding one inch per 10 feet. Such requirements, although given here for one state, are typical of the stringent requirements for drainfields. When one considers the lightweight, flexible polyethylene pipe typically used in such drainfields, and the aggregate of heavy gravel, it is appreciated that holding to such dimensional code requirements is difficult, time consuming and costly. A typical system might include a four inch minimum inside diameter having two rows of holes having a specified perforated area. The perforations must be located at a particular angle from a vertical on either side of centerline of the bottom of the pipe. Further, the pipe must be installed so that the perforations are effective in the effluent treatment. Twisting of the pipe can cause a hole to be at the very bottom during installation. Such a condition will not meet Code and will not pass an inspection. It is required that the perforations be such that the effluent is distributed as equally as possible throughout the drainfield area. It is not unusual for a standard drainfield installation to take a three man crew with back hoe more that a day to install a typical standard subsurface drainfield to within Code tolerances. It is also well known that many installations have to be reinstalled because an inspector failed the original installation because a grade or separation dimension was not met.

As described in U.S. Pat. No. 5,015,123 to Houck et al., conventional drainage systems of the type described and to which the present invention relates typically comprise horizontally extending corrugated and perforated plastic pipe placed within the drainfield area surrounded by a quantity of loose aggregate material, such as rock or crushed stone. By way of example and in the case of the standard subsurface drainfield, the space between the conduit and the ground occupied by the aggregate defines a drainage cavity in fluid communication with the perforations of the conduit. Such a nitrification field comprises effluent discharging from a septic tank through the perforated pipe of a nitrification line which in surrounded by a specified minimum volume of aggregate material, such as rock or crushed stone. The nitrification field creates a storage area for sewage effluent to be absorbed by the soil. The aggregate maintains the boundaries of the storage area, prevents blockage of the pipe perforations, and promotes the beneficial effects wherein aerobic bacteria organisms act on the sewage colloidal materials to reduce them in the soil. The perforated conduit serves the purpose of delivering the effluent to the aggregate filled cavity for absorption into the soil and to vent sewage gases for preventing local contamination. The use of corrugated pipe permits the trapping of effluent for a secondary, a semi-aerobic treatment within the pipe corrugations. As supported by the Houck '123 patent, the requirements for uniformity and inspections for compliance with state and local codes typically makes the drainfield installation process tedious and time consuming. As a result, Houck '123 looks away from the teachings of the standards employing typical gravel aggregate to fill a trench or absorption bed.

U.S. Pat. No. 4,268,189 to Good discloses an apparatus and method for supporting and positioning pipe during the construction of drain fields and the like. The apparatus comprises an elongate support member with spaced apart clamping units arranged for suspending flexible pipe sections from the elongate support member. The elongate support member is adjustably supported for vertical adjustment on vertically disposed anchoring members driven into a grade surface so as to firmly anchor the pipe supporting apparatus during pouring and spreading of aggregate around the pipe sections. The arrangement facilitates the subsequent releasing of the pipe sections from the pipe supporting apparatus and the removal of the pipe supporting apparatus from the aggregate while leaving the corresponding pipe sections embedded in the aggregate. As addressed in the Good '189 patent, the proper positioning of flexible pipe during the construction process has met with difficulty, since such pipe must be maintained in a proper position while being surrounded by the aggregate, as herein earlier described. Clamping the flexible pipe from the sides and below, although securing the pipe during aggregate pouring, can cause movement in the pipe when the apparatus is being pulled from the aggregate. Further, the combination of the elongate horizontal support member and fixed clamping members limit flexibility of use in varying length pipe runs and varying absorption bed layouts. Convenience and ease of use is desirable during the construction process.

U.S. Pat. No. 5,242,247 to Murphy discloses a pipe laying apparatus for maintaining the pipe placement during substantial completion of back filling of a trench in which the pipe is being laid. The apparatus comprises a shaft having an adjustable pipe grasping sleeve for engaging varying sizes of pipe. The apparatus is securely placed in to the trench by manipulation of handles or striking of a strike plate with a hammer. Murphy '247 addresses the need for fast and convenient removal of the pipe laying apparatus from a trench. The use of multiple pipe-holders provides such convenience. However, the apparatus as disclosed by Murphy '247 comprises a pipe support placed below the pipe for holding the pipe at a fixed level. In operation, after backfilling a trench to a level above the pipe, the apparatus is rotated for lifting out of the trench while the pipe remains in place. With drainfields using flexible corrugated and perforated flexible pipe surrounded by aggregate material typically of stone, gravel and the like, rotating the apparatus becomes difficult and causes the flexible pipe to be displaced proximate the apparatus.

U.S. Pat. No. 3,568,455 to McLaughlin et al. discloses a method of laying pipe in a bed of particle material, wherein a series of posts are removably mounted at spaced positions on the ground along the course of the pipe. The pipe is releasably supported on the posts in a raised condition above the ground while particle material is deposited under the pipe to at least a depth at which the deposit can sustain the pipe in its raised condition. The pipe is released from the support of the posts, and the posts are removed from the deposit while the deposit sustains the condition of the pipe. McLaughlin '455 discloses a bracket plate having an arcuate indentation for mating with the top cylindrical surface portion of various sized pipe. The pipe is held within the arcuate indentation by a flexible cable which wraps around the bottom portion of the pipe while hinged to one end of the plate and removably connected to an opposing end for securing the pipe in place. Once the trench has been backfilled, the cable is released from the plate opposing end and the device is lifted from the backfilled trench. Although very effective for generally light materials and generally rigid pipe, again, difficulty occurs when using the flexible corrugated pipe and aggregate combination as earlier addressed. The cable wrapped around the pipe dislodges the pipe from its position as the device is pulled from its position.

SUMMARY OF INVENTION

In view of the foregoing background, it is therefore an object of the invention to provide a system and method for laying flexible drainfield pipe in an absorption bed or trench backfilled with aggregate such as gravel and stone. It is further an object to provide an efficient and thus cost effective method for installing flexible corrugated drainfield pipe having perforations and install such pipe such that it meets code specifications. Yet another object of the invention is to enhance the ease of placement of the drainfield pipe and maintain the placement to within specified code requirements during the backfilling operation. It is yet another object of the invention to provide for effective removal of pipe installation devices after the aggregate is in place. It is yet another object of the invention to provide a method for securing the pipe at a specified grade while clamping the pipe from a top portion thereof, thereby minimizing pipe displacement caused by portions of the device displacing aggregate proximate the pipe or contacting portions of the pipe during removal and thereby displacing the pipe.

These and other objects, features, and advantages of the invention, are provided by a pipe useful in distributing septic tank effluent to a drainfield, and a pipe support useful in the installation of the pipe. The pipe comprises a flexible conduit having a corrugated wall with corrugations extending along a longitudinal axis of the conduit. In one preferred embodiment, each corrugation is generally perpendicular to the axis of the conduit. The conduit includes a flanged end for coupling to an opposing end of an adjacent pipe for placing the adjacent pipe in fluid communication with the pipe. The pipe further comprises an elongate rib integrally formed with the conduit. The elongate rib extends radially outward from and longitudinally along a conduit outside wall portion and is generally parallel to the conduit axis, lying within an imaginary plane including the axis. The rib is positioned for suspending the pipe wherein a portion of effluent carried by the pipe remains within a conduit inside bottom portion, below longitudinally spaced apart perforations within conduit side wall portions. The bottom portion of the conduit radially opposes the rib thus permitting a secondary effluent treatment within the conduit bottom portion. The rib further provides a sufficient pipe stiffening within the rib plane for supporting the pipe in a desired position above a support surface.

A drainfield pipe installation device of the present invention is useful for suspending the corrugated pipe above a grade level prior to pouring aggregate, and comprises an elongate member having a proximal end for supporting a pipe section therefrom and a distal end operable with a grade surface for suspending the pipe section therefrom, and a clamp carried by the elongate member at the distal end thereof, the clamp having opposing first and second jaw members operable from a first position for receiving a top portion of the pipe section therefrom, to a second position for biasing against the top portion in a clamping arrangement. The clamp comprises a handle pivotally attached to the proximal end of the elongate member, and includes a proximal end pivotal about a pivot pin carried at a distal end of the handle, the distal end having the first jaw member carried thereby. A locking pin is slidably carried by the handle for movement into and out of the elongate member proximal end, the locking pin slidable into the hole for securing the handle and thus clamp in the locking arrangement. In one preferred embodiment, the second jaw member is integrally formed with the elongate member proximal end. The first jaw member includes fork elements forming a bifurcated end pivotally attached to the elongate member proximal end and carried therebetween.

Preferably, the elongate member includes opposing first and second anchor members in a spaced relation for receiving the pipe section therebetween. Further, the first and second anchor members include opposing inside edges outwardly tapered from the proximal end toward the distal end thereof. A first separation distance between the opposing inside edges of the first and second anchor members at the distal end thereof provide for a free longitudinal movement of the pipe section therebetween, and a second separation distance at a proximal end thereof positions the opposing inside edges between corrugations of the pipe section for restricting the longitudinal movement thereof. Each of the opposing inside edges includes an arcuate shape transversely positioned for increasing the separation at the distal end, which separation distance allows the pipe to be slide between the elongate members when positioning the pipe prior to suspension by the device. A slot is carried by the elongate member proximal end for receiving the rib and guiding the rib for clamping.

A method aspect of the invention includes installing the pipe at an on-site sewage treatment drainfield comprising the steps of positioning a first set of pipe supporting devices, wherein each device includes means for removably clamping a portion of the device to a pipe rib for holding the pipe in suspended relation above an absorption area grade surface. The absorption area is to be filled with an aggregate such as stone or gravel. Each device further has anchoring means for anchoring each device to the grade surface in a desired alignment for positioning pipe generally horizontally across the absorption area. In one preferred embodiment, the pipe sections are positioned on the grade surface and the devices pushed into the grade surface while straddling above the pipe section. Multiple devices are used to support interconnected pipe sections from corresponding elongate ribs integrally formed on each pipe section. The devices are positioned in spaced relation to each other for supporting the interconnected pipe sections. The supporting devices are adjusted for positioning the first pipe at a desired height above the grade surface. Clamping of the rib is performed for supporting the second pipe sections. Additional pipe sections are positioned for coupling with adjacent pipe sections for forming a drainfield system having pipe sections in fluid communication with each other. The pipe sections are further stiffened by securing the inside edges of the elongate members between the corrugations. Aggregate is then poured around the pipe sections to a desired level above the surface grade for providing an absorption bed in fluid communication with the drainfield pipe sections. The devices maintain the pipe sections at a desired horizontal and vertical position within the absorption area. Once the aggregate is at the desired level above the surface grade and is holding the coupled pipe at their desired position, the pipe members are released from the clamping means thereby placing each pipe section out of communication with the devices. The devices are then removed from their position by manually pulling each device generally upward out of anchoring engagement with the grade surface which results in a drainfield positioned to a specific dimension and in fluid communication with an absorption bed of aggregate surrounding the pipe system of the drainfield.

BRIEF DESCRIPTION OF DRAWINGS

A preferred embodiment of the invention as well as alternate embodiments are described by way of example with reference to the accompanying drawings in which.

DETAILED DESCRIPTION OF PREFERRED EMBODIMENT

Figure 1:
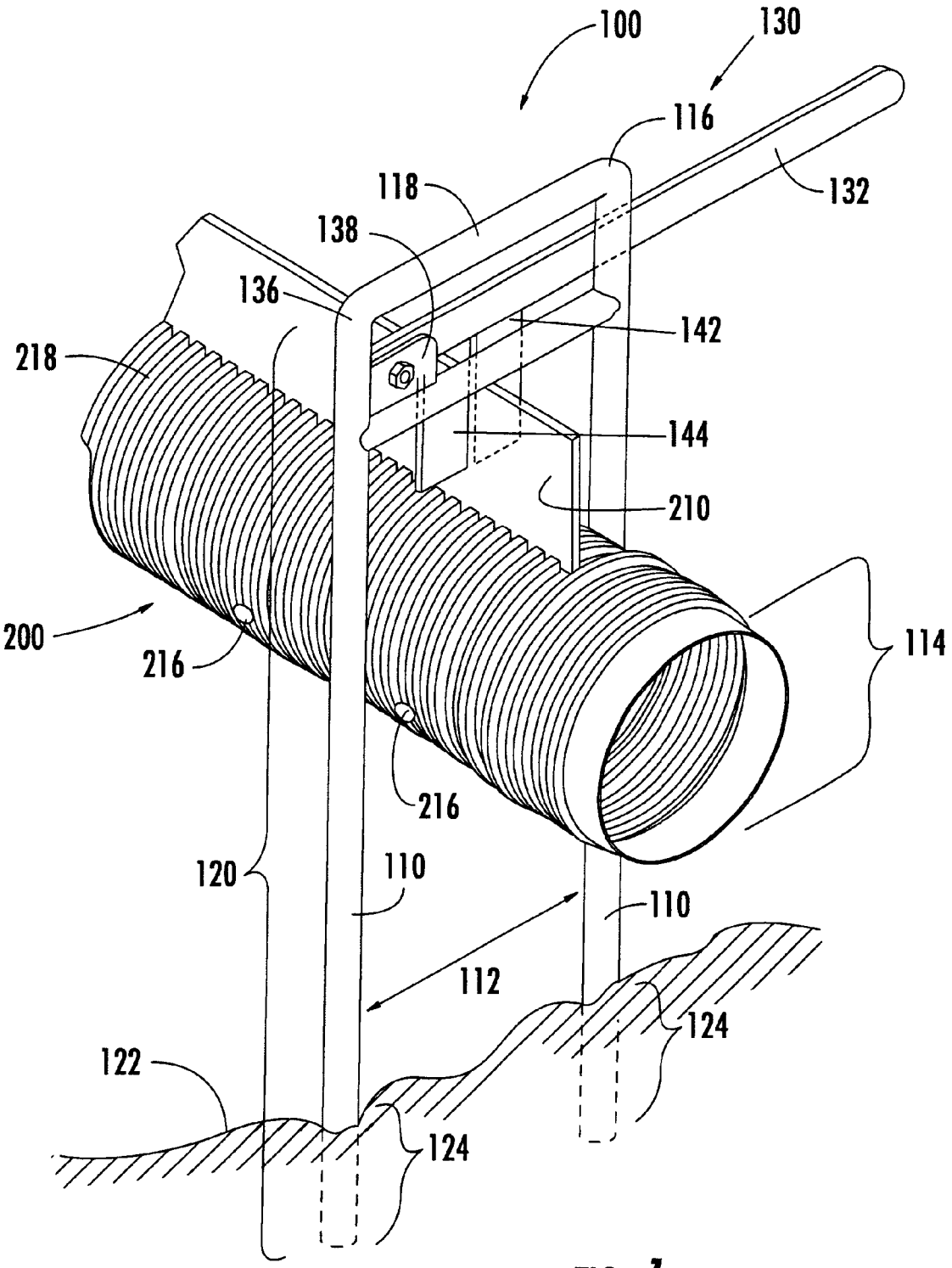
FIG. 1 is a partial left front perspective view of a preferred embodiment of the present invention.
Figure 2:
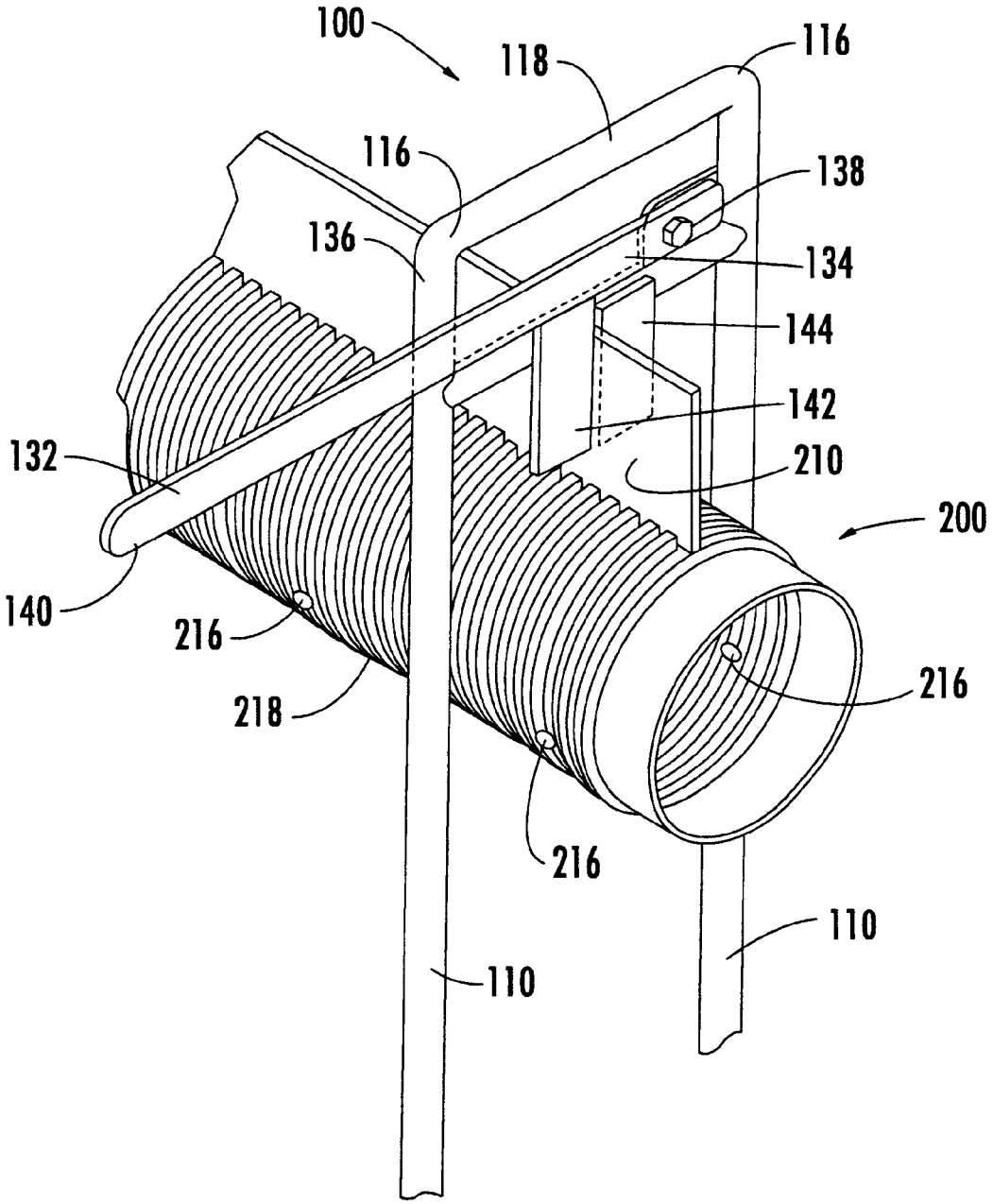
FIG. 2 is a partial right rear perspective view of the pipe supporting device of FIG. 1.
Figure 3:
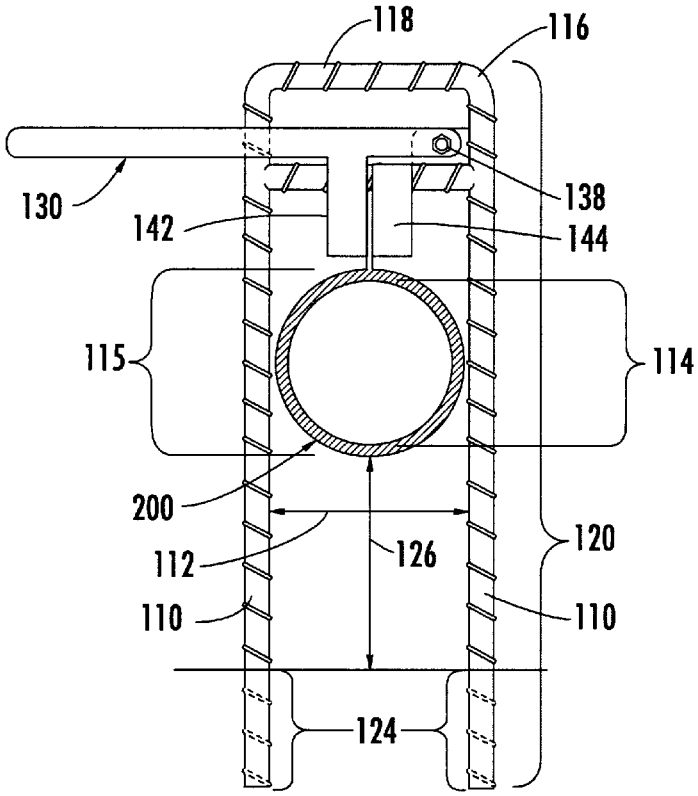
FIG. 3 is a front elevation view of the embodiment of FIG. 1.
Figure 4:
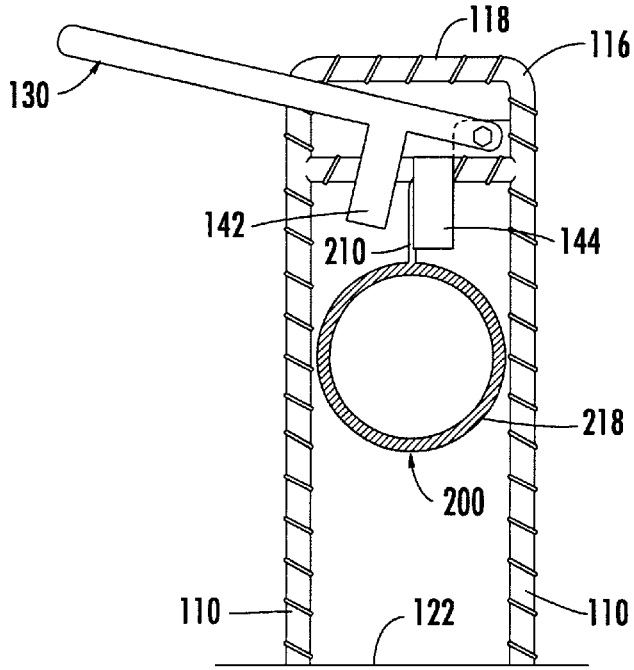
FIG. 4 is a front elevation view of the embodiment of FIG. 3, illustrating a clamp in an open position.
Figure 6:
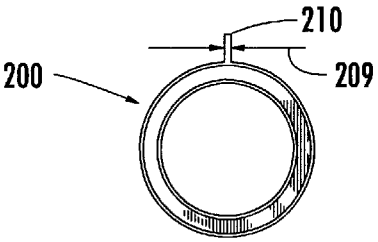
FIG. 6 is a front elevational view of FIG. 5.
Figure 7:
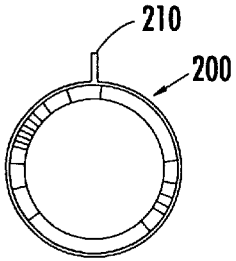
FIG. 7 is a rear elevational view of FIG. 5.
Figure 5:
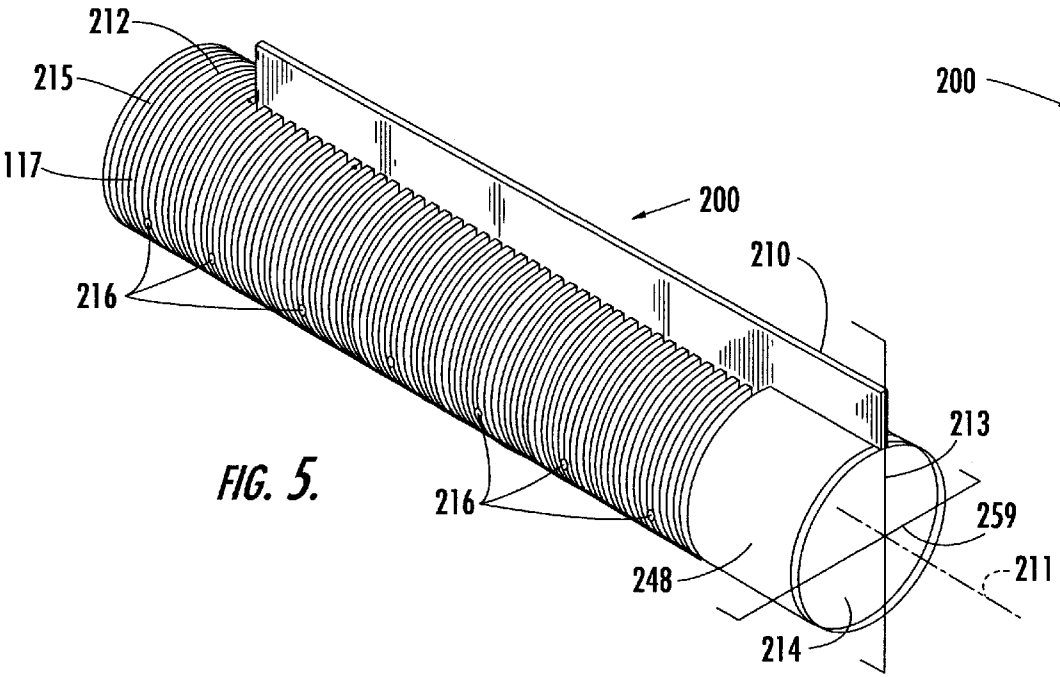
FIG. 5 is a top, left and front perspective view of one preferred embodiment of a drainfield pipe section in accordance with the present invention.
Figure 8:
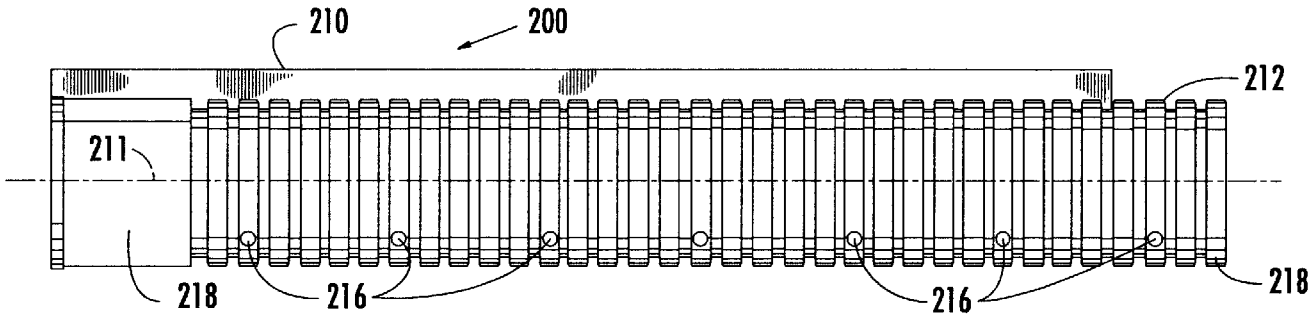
FIG. 8 is a right side elevational view of FIG. 5.
Figure 9:
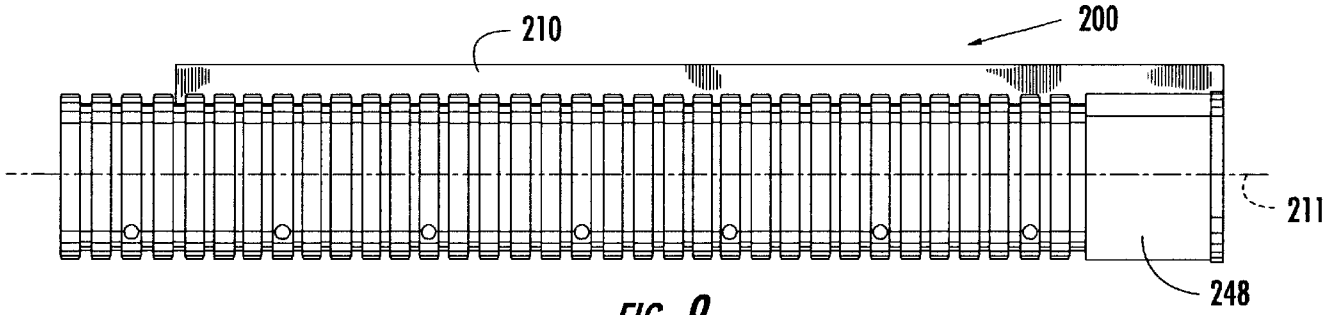
FIG. 9 is a left elevational view of FIG. 5.
Figure 10:
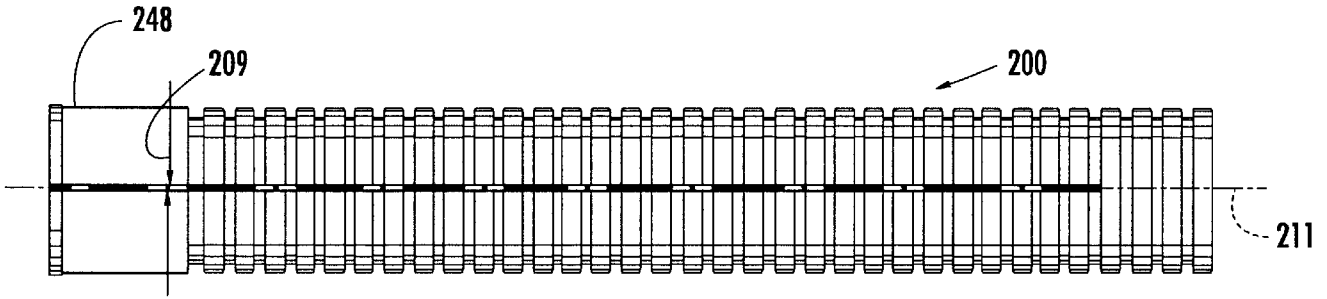
FIG. 10 is a top plan view of FIG. 5.
Figure 11:
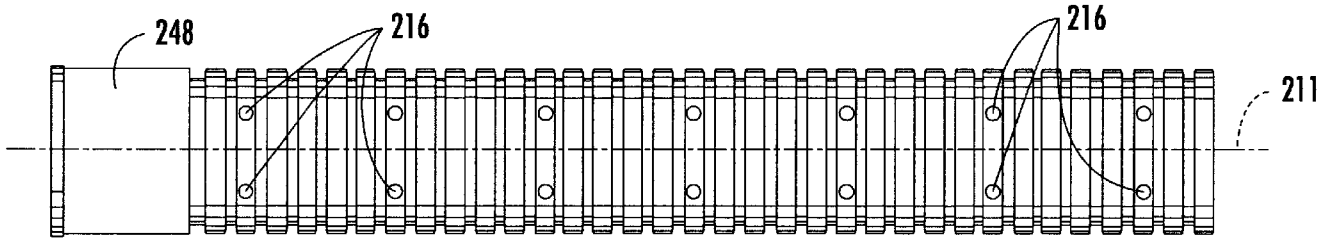
FIG. 11 is a bottom plan view of FIG. 5.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Referring now to FIGS. 1–4, a pipe supporting device 100 used in combination with a drainfield pipe section 200, in one embodiment of the present invention comprises a pair of elongate anchor members 110 generally parallel to each other and separated by a dimension 112 sufficient for receiving the pipe section 200 therebetween. Although it is anticipated that alternate uses of the present invention will be employed, the preferred embodiment is herein described with reference to the corrugated pipe section 200 having an inside diameter 114 of approximately four inches and an outside diameter 115 including corrugations 117 of approximately four and three quarter inches. In a preferred embodiment of the device 100, the pipe section 200 loosely fits between the parallel anchor members 110. Further, in one embodiment, the anchor members 112 are constructed from readily available steel reinforcing bar stock material well known as "rebar" in the construction industry, which rebar is bent at two locations 116 to form the separation dimension 112 and a device handle portion 118 therebetween again as illustrated with reference to FIGS. 1–4, by way of example. Any similar bar stock or extrusion that can support the pipe section 200 being handled can be used. The length 120 of the elongate anchor members 110 must be sufficient to penetrate a grade surface 122 to a depth 124 sufficient to hold the anchor members 110 upright without other support means while extending the pipe section 200 above the grade surface 122 by a desired height 126.

As illustrated with reference to FIGS. 5–11, the pipe section 200 comprises a rib 210 that extends radially outward from a longitudinal center axis 211 of the pipe section 200. In one preferred embodiment of the present invention, the rib 210 is integrally formed with the pipe section or can be welded along a pipe section top portion 212. The rib 210 must be sufficiently dimensioned to stiffen the pipe section 200 for limiting flexibility of the pipe section 200 within an imaginary plane 213 passing through the pipe section longitudinal axis 211 and including the rib 210. In the embodiment herein described, the rib 210 made from the pipe material, is integrally formed with the pipe conduit 215, and has a rib thickness dimension 209 of approximately one eighth inch. With such a rib thickness dimension 209, the rib 210 is sufficient to limit flexibility within the plane 213 and permit the supporting devices 100 placed along the pipe section length to hold the pipe section 200 to within a desired elevation and grade or slope.

Figure 12:
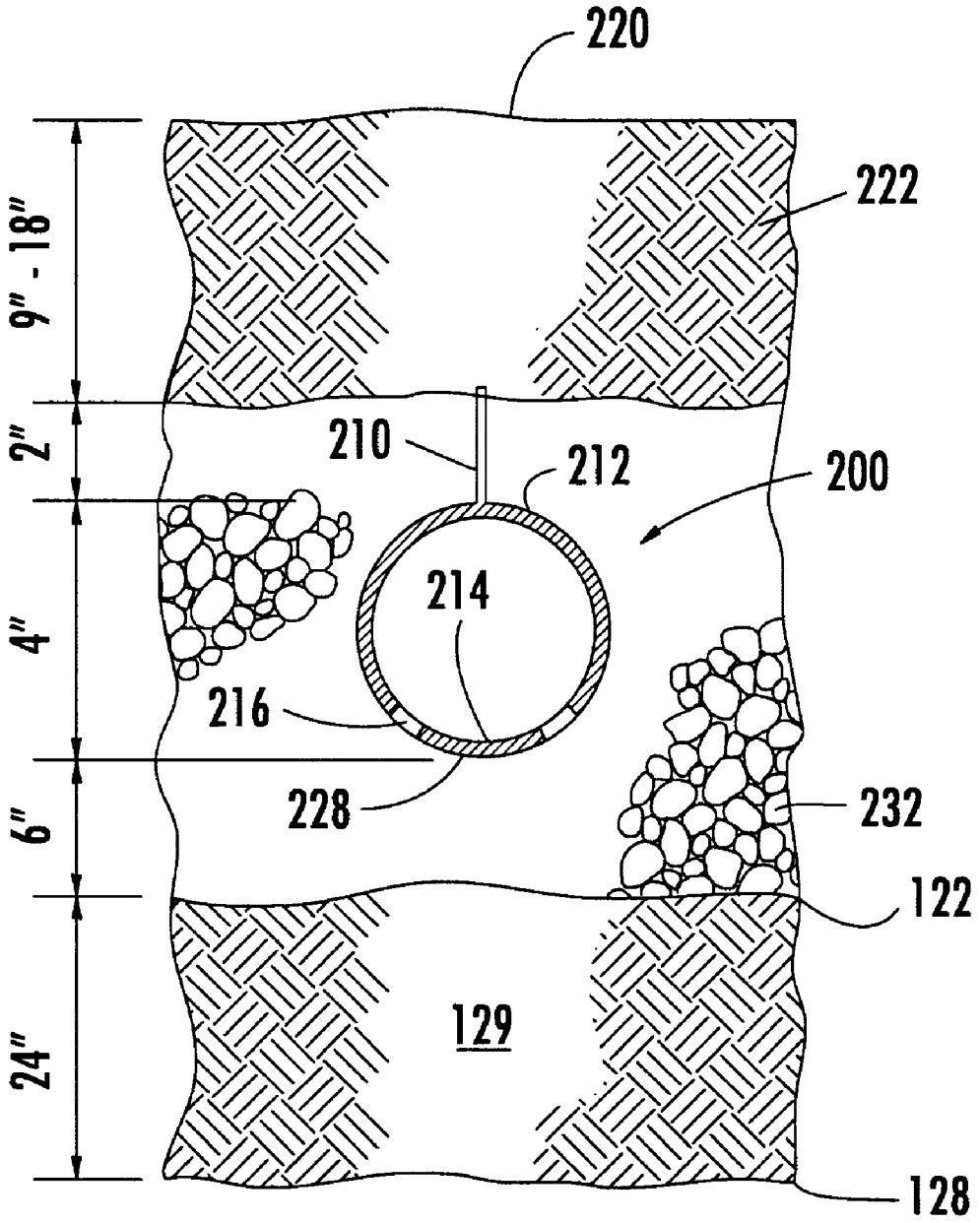
FIG. 12 is an elevational cross-section view of the drainfield pipe of FIG. 5 illustrating its position within a drainfield absorption bed.
Figure 13:
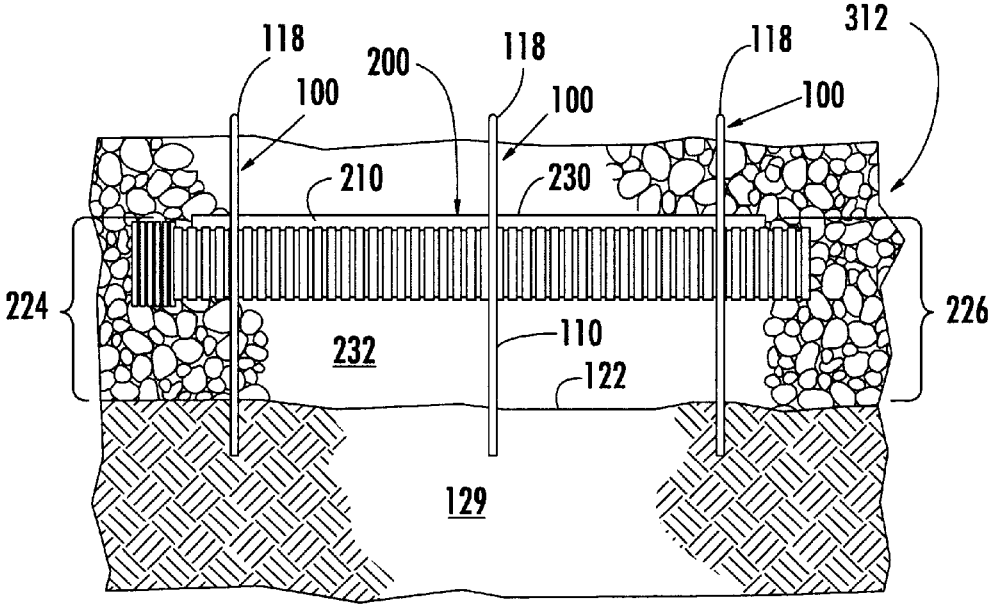
FIG. 13 is a side elevational view of an embodiment of the present invention illustrating use for positioning the pipe section.

As illustrated with reference to FIG. 12, the rib 210 opposes a pipe section bottom portion 214 which holds effluent within the bottom portion 214 during the operation of the drainfield, as will be further detailed later in this section. The bottom portion 214 is further defined by holes 216 located along pipe section side portions 218. As earlier described in the background section of this specification, and given here by way of example, the maximum depth from the bottom of the drainfield 312, as described with reference to FIG. 12, and as will be further described later in this section, the grade surface 122 to the finished ground surface 220 must not exceed 30 inches after natural settling. A minimum earth cover 222 over the top of the drainfield, distribution box or header pipe in standard subsurface drainfields shall be 6 inches after natural settling. By way of example, depending on the type of drainfield system being utilized, the drainfield absorption surface is to be constructed level or with a downward slope not exceeding one inch per 10 feet. In other words, the elevation above grade from a first pipe section end 224 to a second pipe section end 226 must not exceed one inch for every foot along the pipe section 200 as illustrated with reference to FIG. 13. As illustrated, again with reference to FIG. 12, an effective drainfield for a typical Central Florida absorption bed styled installation has the grade surface 122 approximately twenty four inches above natural wet soil 128 for forming a dry soil layer 129. A pipe section bottom most surface 228 is positioned at six inches above the grade surface 122. With a four inch diameter pipe section 200, the top most surface 230 of the pipe section 200, not including the rib 210, will be ten inches above the grade surface 122. With a rib 210 having a two inch height dimension 211, aggregate 232 is filled to the top end 214 of the rib for providing twelve inches of aggregate within the absorption bed area. If a soil cap or earth cover 222 of approximately nine to twelve inches in placed over the aggregate top surface 236, an effective drainfield is constructed within the code specifications. Further, a two inch rib 210 provides additional margin and a precise way of determining the depth of aggregate covering the pipe section 200 under typically adverse installation conditions.

Figure 14:
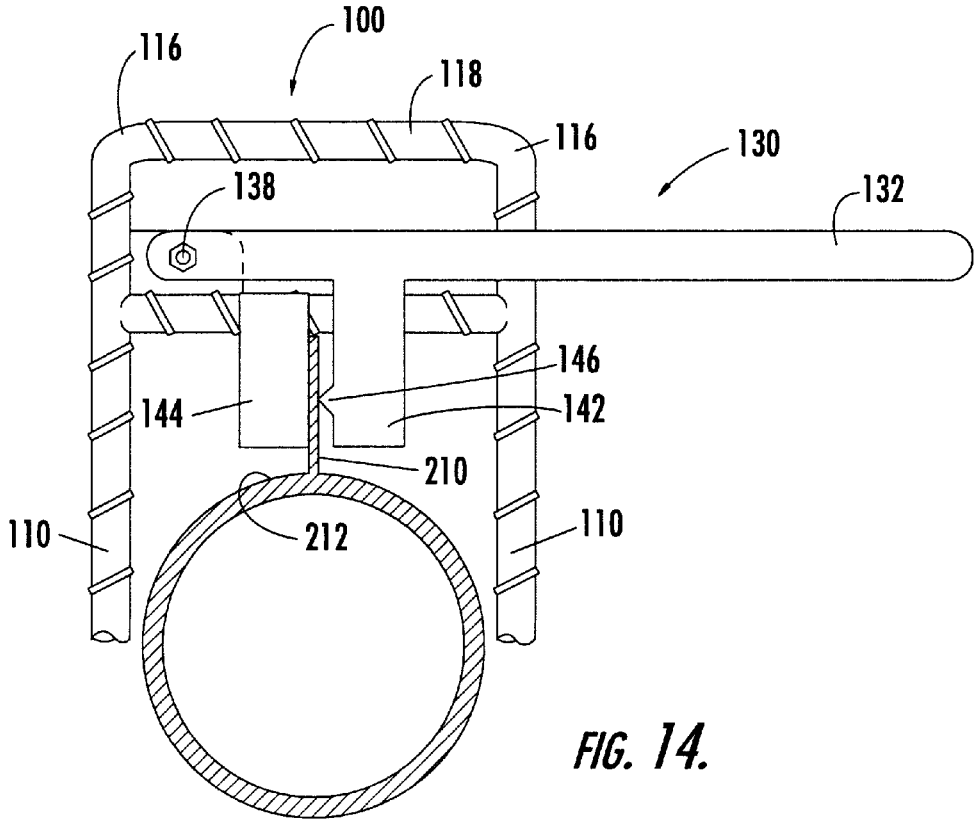
FIG. 14 is a partial front elevational view of a clamp portion of an alternate embodiment of the present invention.

To accomplish such a configuration as herein described by way of example, the device 100 must hold the pipe section 200 at the desired elevation above the grade surface 122. Again with reference to FIGS. 1–4, the device 100 further comprises a clamp 130 having a clamp handle 132 pivotally attached at a distal end 134 to an anchor member upper portion 136 using a pivot pin 138. A handle proximal end 140 permits the handle to be held for movement about the pivot pin 138. In the preferred embodiment of the present invention, a first jaw member 142 is affixed to the clamp handle 132 proximate the handle distal end 134. A second jaw member 144 is affixed to the anchor member upper portion 136 for communicating with the first jaw member 142 in holding the rib 210 between the jaw members 142, 144 as again illustrated with reference to FIGS. 1–4. As illustrated with reference to FIG. 14, an alternate embodiment of the clamp 130 comprises a pin 146 extending from the first jaw 142 for penetrating a rib side wall surface 238 for enhancing a frictional force between the jaws 142, 144 while holding the rib 210 therebetween and thus the pipe section 200 in the desired position above the grade surface 122. Further, and again with reference to FIG. 13, multiple devices 100 are used longitudinally along the pipe section 200 to support the full pipe section 200 or interconnected sections 201, as illustrated with reference to FIGS. 15–17, and as will later be described.

Figure 18:
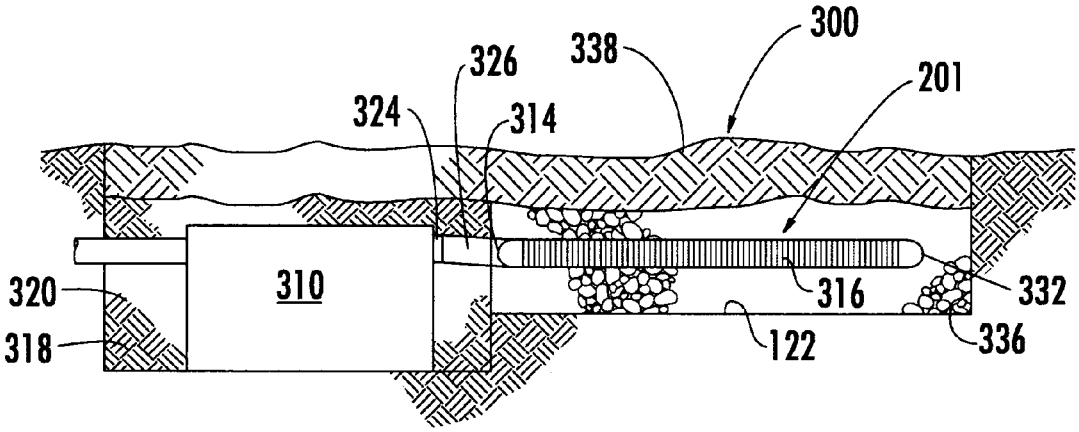
FIG. 18 is a partial side elevation view of an on-site sewer treatment system illustrating a relationship between a septic tank and drainfield.
Figure 19:
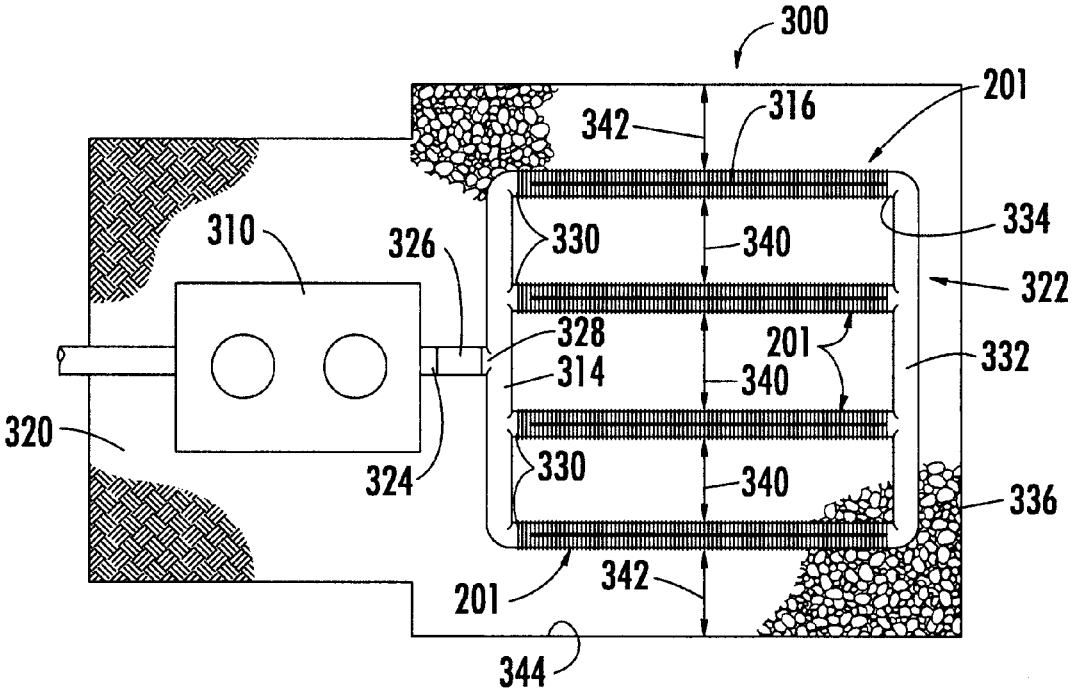
FIG. 19 is a partial top plan view of the sewer treatment system of FIG. 18.

By way of example, a method for installing an on-site sewage treatment system 300 comprising a septic tank 310 and drainfield 312 efficiently and effectively to within code specifications is described with reference to FIGS. 18 and 19 for a well known subsurface drainfield system comprising a header 314 pipe used for distributing effluent into the corrugated pipe sections 316 making up the drainfield 312. In one preferred installation method using the drainfield pipe sections 200 and supporting devices 100 earlier described, the septic tank 310 is positioned at a tank bed surface 318 within a pit 320 dug for placement of the tank 310. A drainfield absorption area 322 is dug wherein the drainfield bed grade surface 122 is at an elevation sufficient for providing a drainfield 316 at an elevation including aggregate 232 around the drainfield 316. The septic tank 310 is positioned for permitting effluent to flow into the drainfield 316 which is in fluid communication with the tank 310. Effluent from the tank 310 passes through a tank outlet port 324 through interconnect pipe 326 to the header pipe section 314 as illustrated again with reference to FIGS. 18 and 19. Typical header pipe sections 314 comprise an inlet junction 328 for connection to the interconnect pipe section 326 and multiple outlet junctions 330 for connection with the drainfield pipe sections 200. The method comprises the step of positioning a first set of pipe supporting devices 100 longitudinally along the header pipe section 314 and supporting the header pipe section 314 at a desired elevation and position within the absorption area 322. By way of the example illustrated with reference to FIG. 18, the header pipe section 314 is positioned below the tank outlet port 324 for gravity feeding of effluent from the tank 310 into the header pipe section 314. The header pipe section 314 is supported by placing devices longitudinally along the header pipe section 314 approximately every two to three feet in the same way as earlier described with reference to the drainfield pipe sections 200. In the preferred embodiment, the header pipe section 314 comprises a rib 210 as earlier described but does not include holes 216 as does the drain field pipe sections 200. The support devices 100 are vertical adjusted by pushing each device 100 into the grade surface 122 or pulling upward from the surface 122 until the desired level for that corresponding portion of header pipe section 314 is at a desired grade or elevation. A method well known for determining elevation uses a laser beam radiating at a given elevation above ground level with drainfield element elevations measured from that beam elevation. It is anticipated that various well known elevation measuring methods will be used during the installation process. Once the header pipe section 314 is at the desired elevation, it is placed in fluid communication with the interconnect pipe 326.

Figure 15:
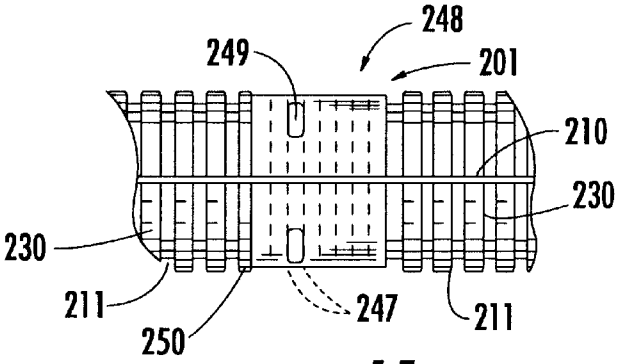
FIG. 15 is a partial top plan view of connected pipe section end portions.
Figure 16:
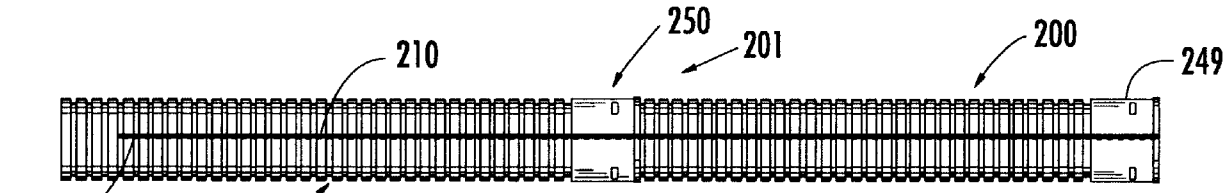
FIG. 16 is a top plan view of connected pipe sections.
Figure 17:
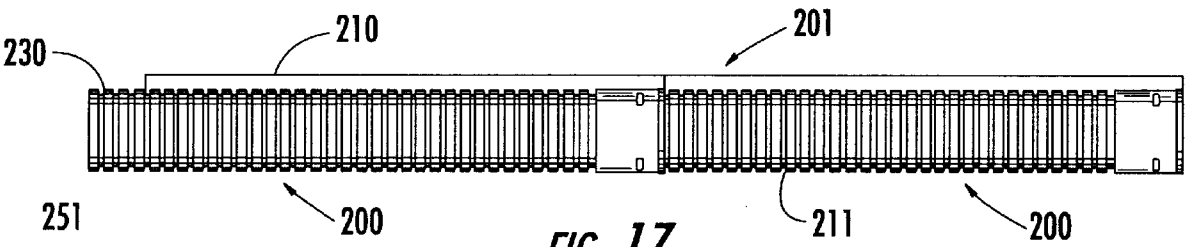
FIG. 17 is a left side elevational view of the connected pipe sections of FIG. 16.
Figure 20:
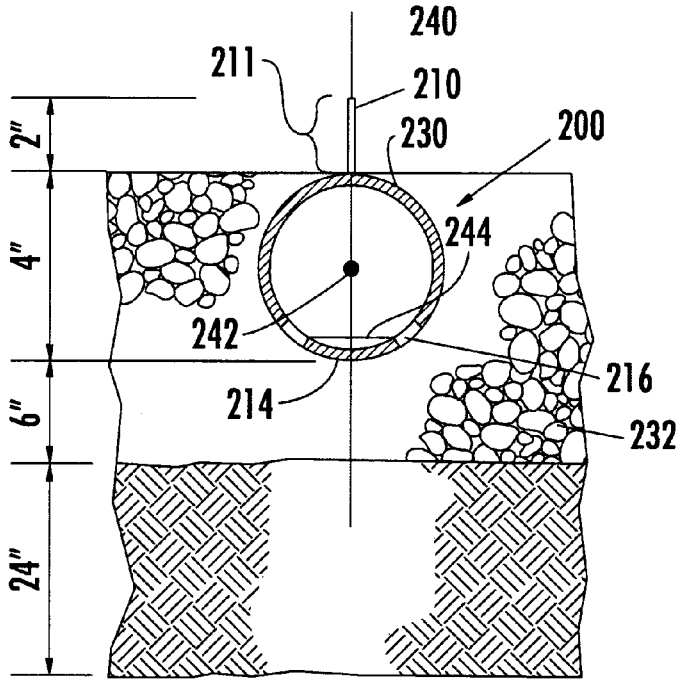
FIG. 20 is a partial cross-section view of a pipe section of the present invention positioned within a partially filled absorption bed.

Joined pipe sections 201, as illustrated with reference to FIG. 18, and as earlier described with reference to FIGS. 15–17 are connected at one end to the header pipe section outlet junctions 330. As earlier described with reference to FIG. 12, the rib 210 opposes the pipe section bottom portion 214. With the device 100 supporting the pipe section 200 such that the plane 213 including the rib 210 is generally vertical (the rib 210 extends radially outward from the axis 211), it is guaranteed that effluent 244 will be collected within the pipe section bottom portion 214 and retained within the pipe bottom 214 below the holes 216. It is here that secondary treatment of the effluent 244 takes place as illustrated with reference to FIG. 20. Additional sets of pipe section 200 are supported by the devices 100 in a similar manner. With reference again to FIGS. 18 and 19, and herein described by way of example, a second header pipe section 332 is connected to ends 334 of the drainfield connected pipe sections 201. The second header pipe section 332 is similar to the header pipe section 314 with the exception that no inlet junction 328 is needed for the example given herein. A second header inlet junction is either eliminated from the header or blocked off for the example given with reference to FIGS. 7 and 8. With such an arrangement, the tank 310, the interconnect pipe section 326, header pipe section 314, pipe sections 201, and second header pipe section 332 are in fluid communication with each other. With ribs 210 made a part of each pipe section used in the treatment system 300, the devices 100 will support these sections from top portions of the pipe sections.

During installation, the pipe sections 314, 201, and 332 are each clamped to devices 100 placed in spaced relation along the sections, generally every two to three feet for the example herein described. Each device 100 is anchored into the bed grade surface 122. In one approach, the devices 100 are placed by estimating their desired location and a more precise alignment and elevation is determined using well known leveling methods as a follow-up procedure. It is anticipated that each operator of the devices 100 and pipe sections 200 will develop alternate techniques understood to be a part of the inventive method and structures herein described.

Aggregate 336 is then distributed into the absorption bed area 322 as illustrated again with reference to FIGS. 18 and 19. With rigidity added to vertical movement of the pipe sections 314, 201, and 332 by the rib 210 sufficient to maintain the sections at the desired elevation when supported by the devices 100, aggregate 336 can be poured uniformly throughout the bed area 322 to a height just covering the rib 210. In this way, the clamp handle 132 is held and pivoted for opening the jaws 144, 146 and thus releasing the frictional hold of the rib 210. With a loose pivot pin 138, the weight of the handle proximal end 140 as a moment arm. Alternately, with a tightened, frictional holding pivot pin 138, the rib 210 is also sufficiently held with biasing of the jaws 142, 144. The devices 100 are then pulled out of their position and removed for covering of the aggregate 336 by appropriate cover material 338 as illustrated again with reference to FIGS. 18 and 19 and as earlier described with reference to FIG. 12.

Again with reference to FIG. 20, an alternate procedure includes filling aggregate 232, typically gravel or crushed concrete and stone material, to the top most pipe section surface 210 while keeping the rib 210 exposed for inspection after the devices 100 have been removed. The rib 210 provides an excellent visual indication of drainfield alignment and it has been experienced that examining authority inspectors gain confidence that a drainfield is properly installed resulting in efficiency in the approval process as well as the installation process. Aggregate 232 can then be poured to cover the rib 210 or earth cover 222 described earlier with reference to FIG. 12, can be poured directly thereon.

Figure 21:
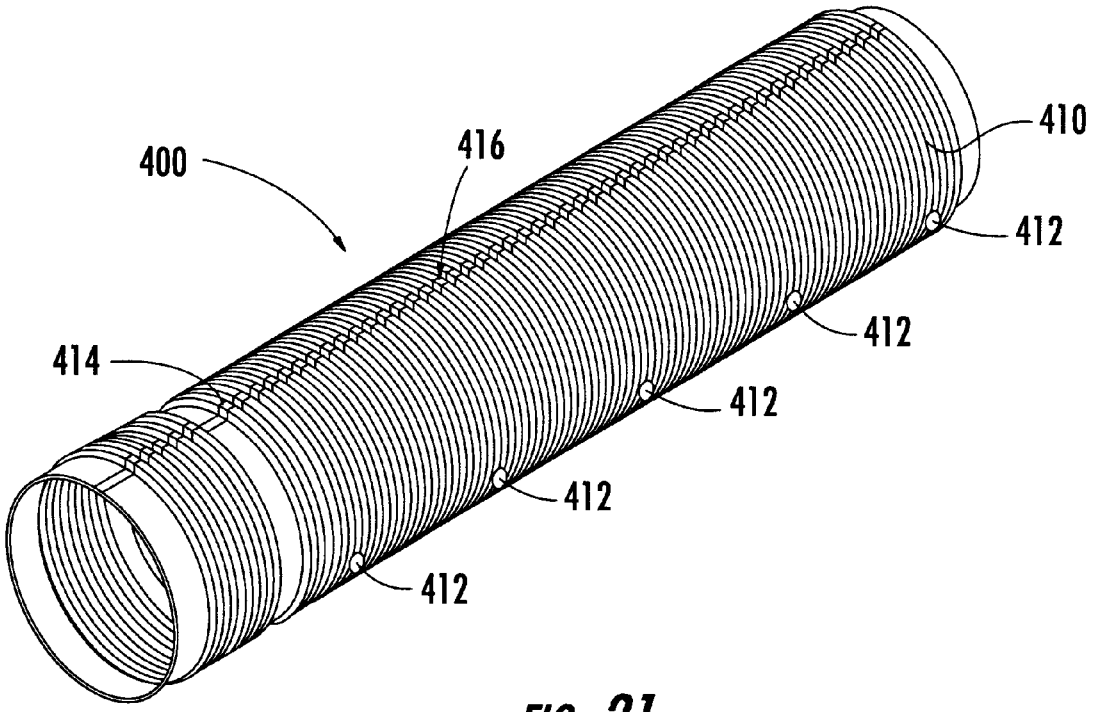
FIG. 21. PRIOR ART
FIG. 21 is a perspective view of a drainfield corrugated pipe well known in the art.
Figure 22:
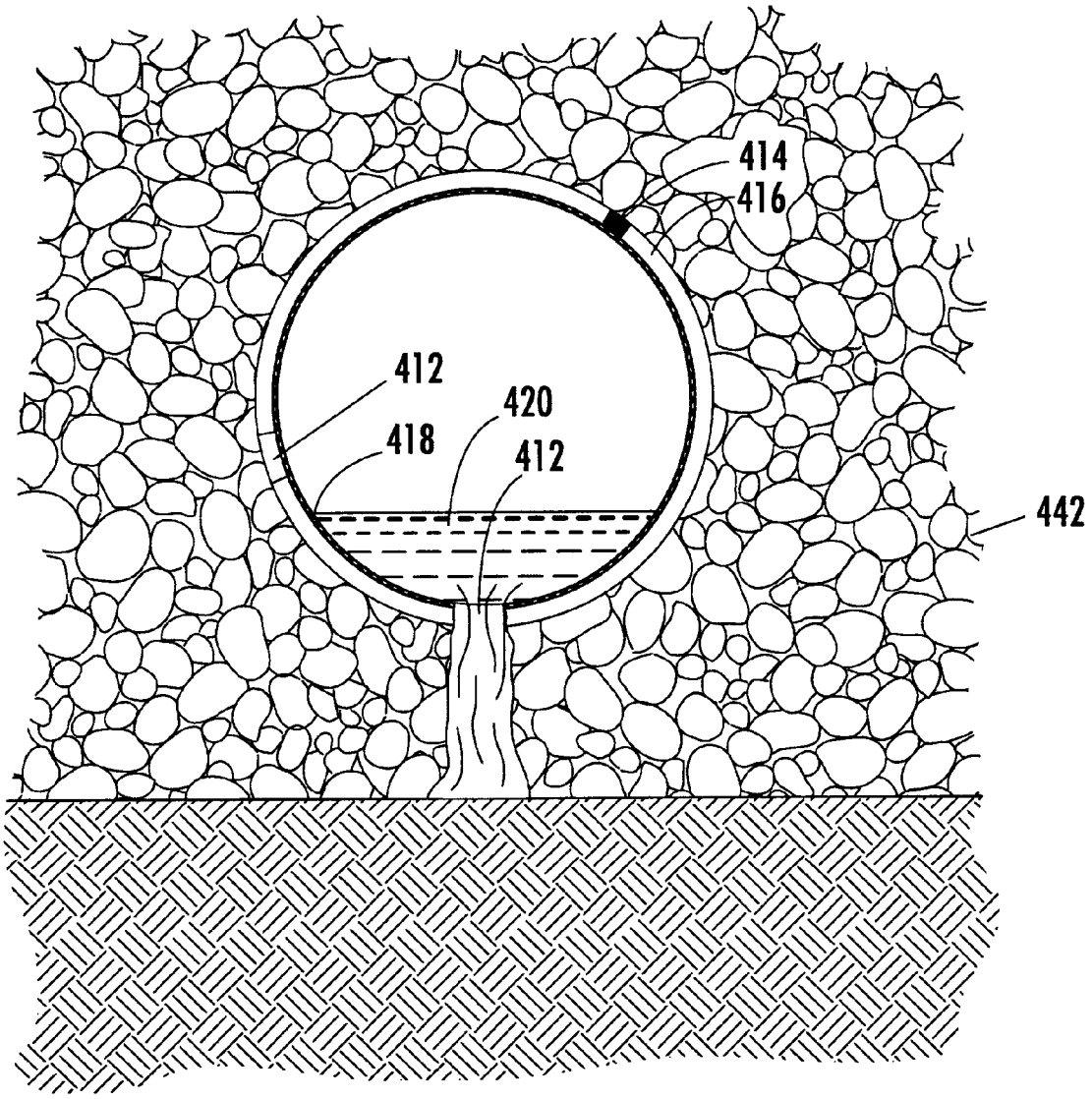
FIG. 22 is a partial cross-sectional view of the pipe of FIG. 21 illustrating twisting of typical pipe used within aggregate for a typical drainfield.

For a fuller appreciation of the needs in the industry, and with reference to FIG. 21, consider a drainfield pipe section 400 well known in the art of drainfield installations and construction and used extensively for on-site sewage treatment systems. Such pipe section 400 includes corrugations 410 and is well known to be highly flexible and difficult to align. The pipe section 400 is positioned for placing the holes 412 such that effluent being carried by the pipe section 400 will drain, while maintaining portions of the effluent within the pipe section below the holes 412. To aid in the installation of pipe sections 400, a stripe 414 is typically painted along a pipe section top surface portion 416 wherein the stripe 414 opposes that inside pipe portion 418 where secondary effluent treatment must take place. As illustrated in FIG. 22, if the pipe section 400 twists during installation, as it very often does, as witnessed by the need to add the stripe 414 for inspection of hole 412 positioning, effluent 420 intended to be held within the lower inside pipe portion 418, will drain directly into the absorption bed 422 thus avoiding desired secondary treatment.

As described earlier within the background section of this specification, various devices have been developed in an attempt to satisfies the needs associated with the typically difficult installation. Twisting of the pipe sections 400 often goes unnoticed until a final inspection, at the expense of much labor and time needed to correct the situation. Further, it is desirable to have independent support, such as the devices 100 of the present invention, to have freedom to remove a single device 100 during the pouring of aggregate for partial lengths of pipe sections 200.

Figure 23:
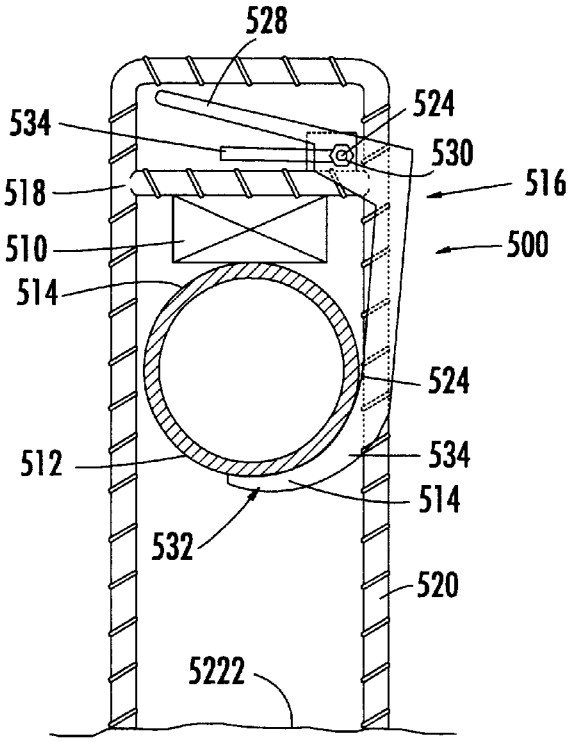
FIG. 23 is a front elevation view of a pipe holding device.
Figure 24:
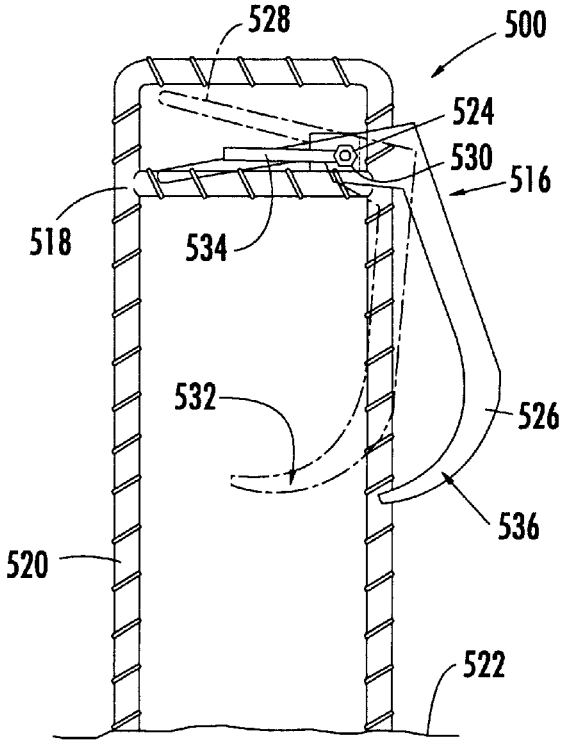
FIG. 24 is a partial elevation view of the embodiment of FIG. 23 illustrating a clamp in closed and open positions.

During the development of the present invention, individual support devices 500, as herein described with reference to FIGS. 23 and 24, were used and incorporated an elongate wooden plank 510 for supporting the pipe section 512. The plank 510, typically a 2×4, is held on a pipe section top surface 514 by a clamp 516 rotatably attached to an anchor top portion 518. The device 500 comprises elongate anchor members 520 for penetrating the grade surface 522 as earlier described for positioning the pipe section 512 at a desired elevation and position within the absorption bed. In one embodiment of the device 500 herein described, the clamp 514 partially surrounded one pipe section side 524 when in a closed position 524 as illustrated with reference to FIG. 24. The clamp 516 pivots about a pivot pin 524 positioned between a clamp distal end 526 and a clamp handle end 528. In the embodiment illustrated, the pivot pin 524 communicates with a lock nut 530 for frictionally holding the clamp 514 in its closed position 532. A wrench handle 534 attached to the nut 530 permits adjustment for tightening for the closed position 534 and loosening for an open clamp position 536 needed for removing the device 500.

Figure 25:
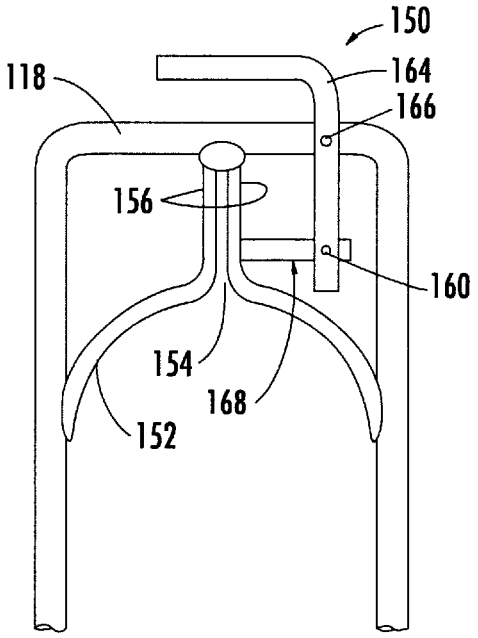
FIG. 25 is a partial front elevation view of an alternate embodiment of a supporting device of the present invention.
Figure 26:
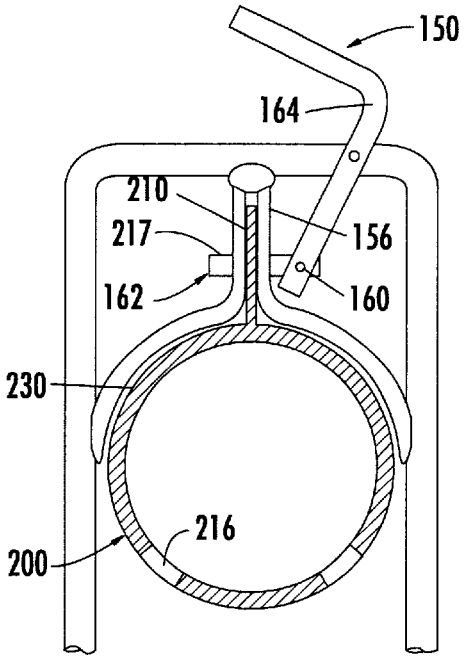
FIG. 26 is a partial front view of the embodiment of FIG. 25 illustrating the device clamping a rib of a pipe section.

Alternate embodiments of the devices 100 and pipe sections 200 are anticipated, some of which have been developed and are herein described. In another embodiment 150 of the support device 100, as illustrated with reference to FIGS. 25 and 26, the pipe section top surface portion 230 is held within a cradle member 152. A slot 154 is formed by tab members 156 extending from the device handle 118. The rib 210 slides within the slot 154 sufficiently deep to have the pipe section top portion 230 rest against the cradle member 152 as illustrated again with reference to FIG. 26. A pin 158 is rotatably attached to a clamp handle distal end 160. The pin 158 is positioned to move into the slot 154 in a pin closed position 162 wherein it extends into an aperture 217 of the rib 210 for holding the pipe section 200. Once aggregate has been poured to its desired level, the pin 158 is pulled out of the rib aperture 217 and out of communication with the rib 210 by rotating a clamp handle 164 on a clamp proximal end 166 separated by the clamp distal end 160 by a second pivot pin 166 positioned for providing such movement. In an opened pin position 168, the rib 210 is out of communication with the pin 158 thus permitting the device 150 to be pulled out of engagement with the pipe section 200.

Figure 27:
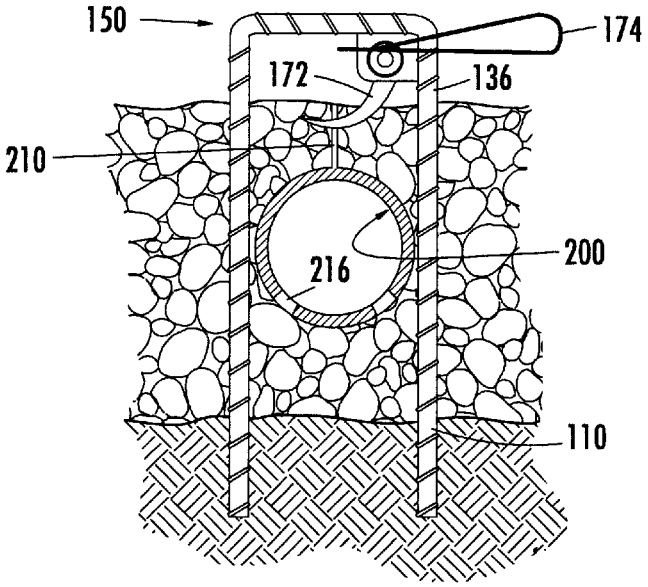
FIG. 27 is a front elevation view of an alternate embodiment of the present invention.
Figure 32:
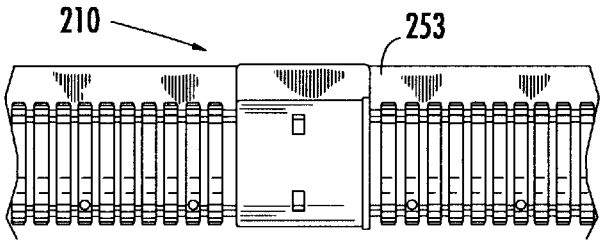
FIG. 32 is a partial side elevation view of FIG. 31.
Figure 29:
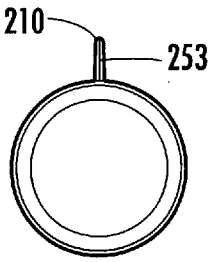
FIG. 29 is a front elevation view of FIG. 28.
Figure 30:
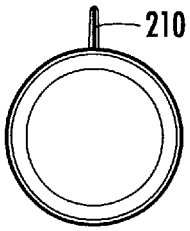
FIG. 30 is a real elevation view of FIG. 28.

In yet another embodiment 170, as illustrated with reference to FIG. 27, the rib 210 is held by a hook 172 penetrating the rib 210 at one end and pivotally attached to the anchor member upper portion 136. As earlier described with reference to FIGS. 23 and 24, a nut and wrench handle assemble 174 is used to lock the hook 172 in a closed position in communication with the rib 210 and loosen the hook 172 for pivoting out of communication with the rib 210 for pulling the device 150 away from the aggregate 232. The devices 150, 170 are also used in a preferred method for installing the drainfield as described with reference to the device 100 embodiment.

Figure 28:
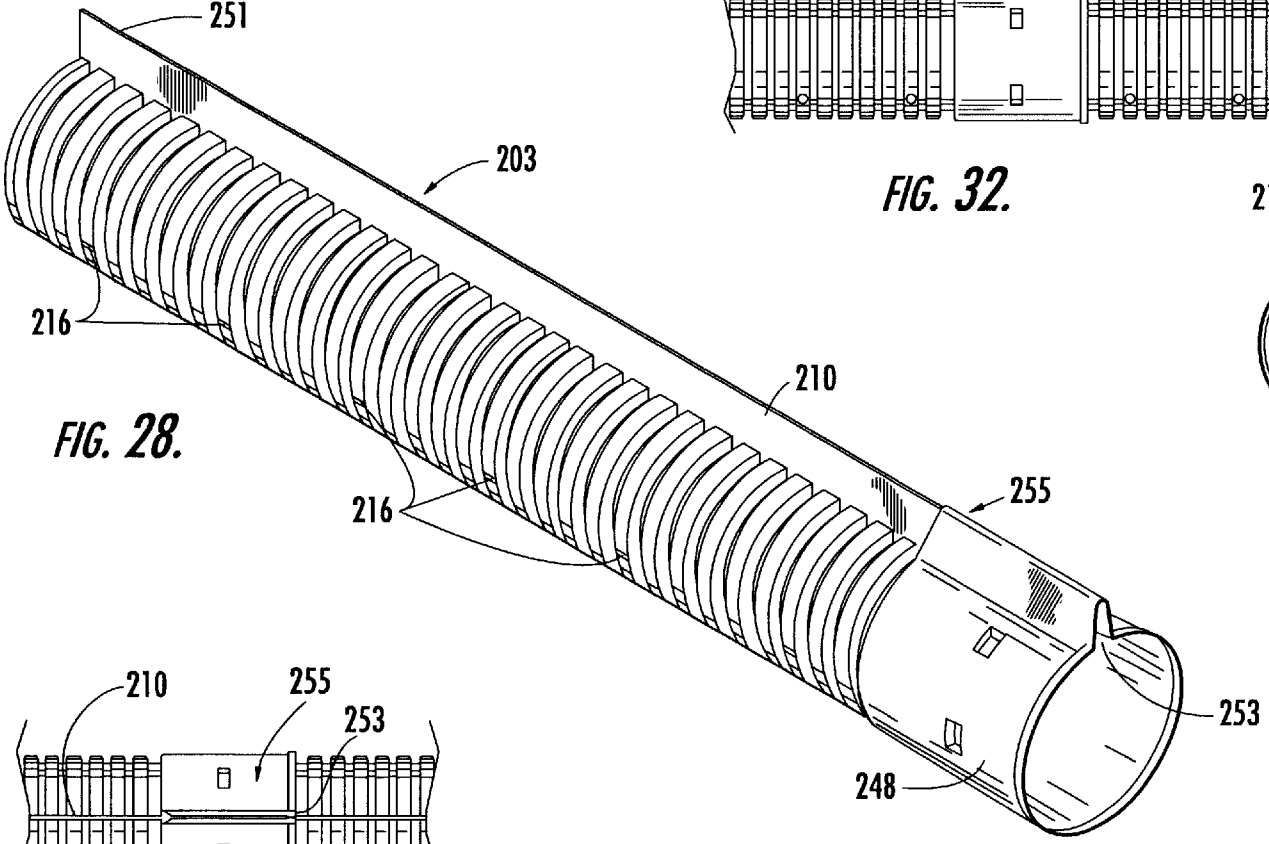
FIG. 28 is a top, left and front perspective view of an alternate embodiment of the pipe section of the present invention.
Figure 31:
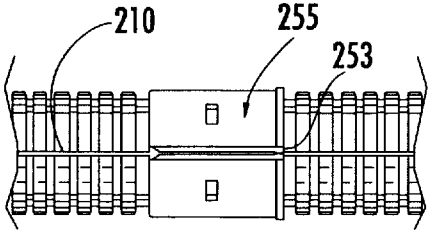
FIG. 31 is a partial top plan view illustrating connecting pipe sections of FIG. 28.
Figure 33:
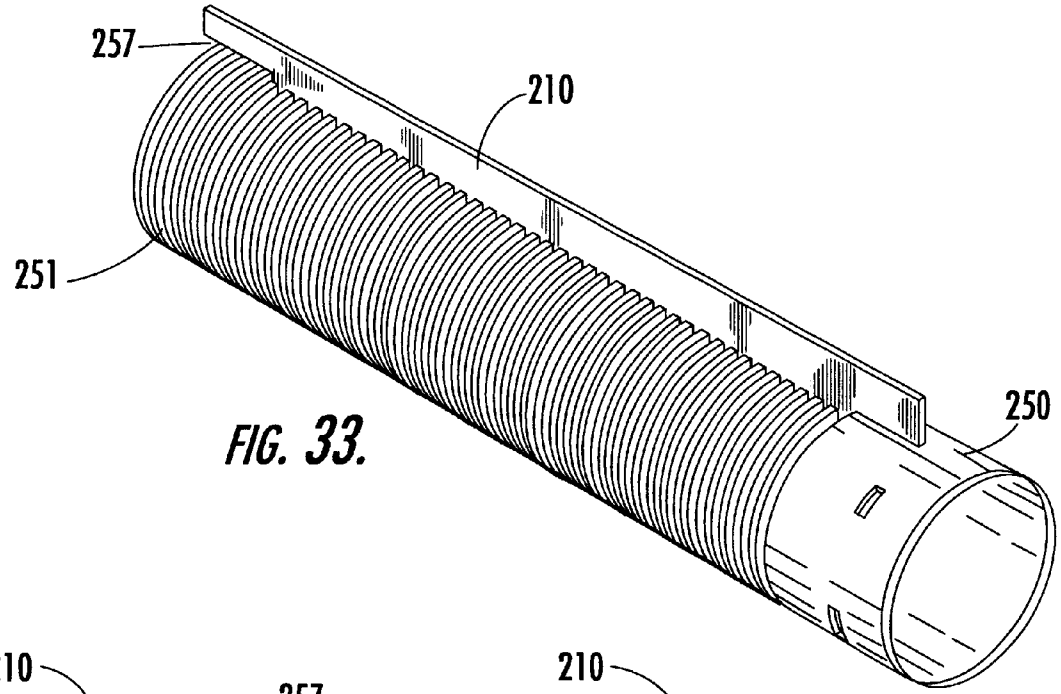
FIG. 33 is a top, left and front perspective view of yet another alternate embodiment of the pipe section of the present invention.
Figure 34:
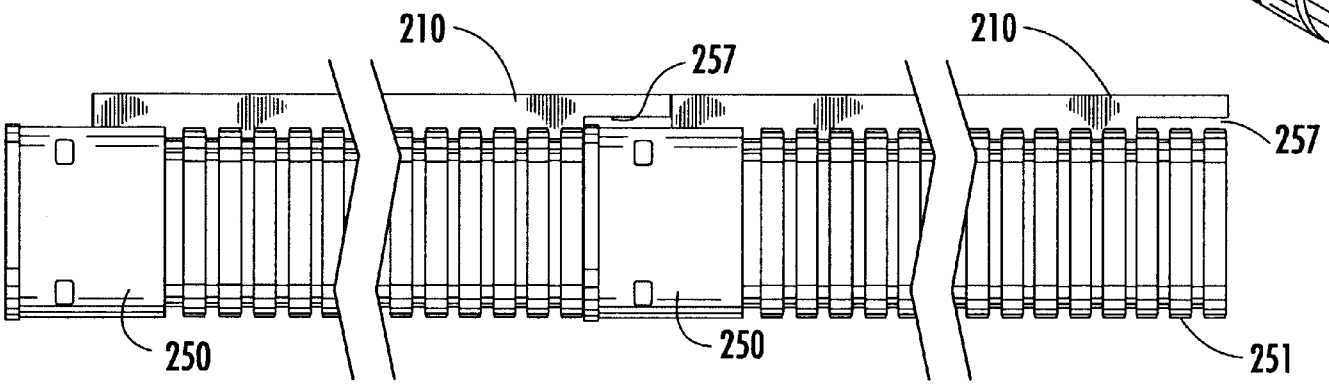
FIG. 34 is a partial side elevation view illustrating connecting pipe sections of FIG. 33.

Likewise for the pipe section 200, alternate embodiments expand on the features herein described and carry the benefits of the present invention. With reference again to FIGS. 15–17, the rib 210 is extended along the pipe section top surface 230 including corrugated pipe conduit 211 and extends onto a female end connection flange portion 248 thus permitting a junction or interconnect location 250 accessible for removable attachment by the device 100. In addition, the flange portion 248, includes recessed wall portions 249 positioned for interlocking between adjacent corrugations 247, as illustrated again with reference to FIG. 15. By extending the rib 210 onto the flange portion 248, and stopping the rib 210 short of the male pipe section end portion 251, the male portion 251 fits within the flange portion 250 and permits a generally continuous rib 210 within the joined pipe section 201 as illustrated again with reference to FIGS. 16 and 17. In an alternate embodiment of the pipe section 203, as illustrated with reference to FIGS. 28–32, the rib 210 extends fully across the pipe topmost surface 230 from end to end, from male end portion 251 to flange end portion 250, unlike that earlier described with reference to pipe section 200, illustrated and described earlier with reference to FIG. 5, and supporting drawings. However, in the pipe section 203, the rib 210 at the flange portion 248 is doubled walled for permitting the singled walled rib 210 at the male end portion 251 to be received within a channel 253 formed by the double walled rib portion 255. In yet another embodiment, a pipe section 205, as described with reference to FIGS. 33 and 34, includes a notch 257 within the rib 210 at the male end portion 261. The rib 210 extends to the end of the pipe male end portion 251 as earlier described with reference to FIG. 28. In this embodiment, pipe section 205, the notch 257 receives the flange end portion 250 and permits the continuous rib 210 for the connected pipe sections 201.

Figure 35:
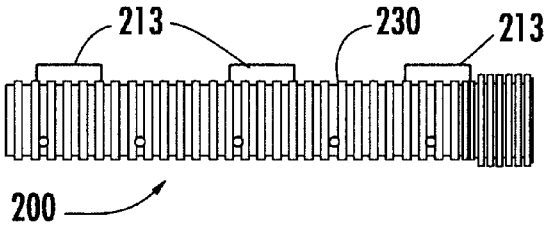
FIG. 35 is a side elevation view of a pipe section having an alternate rib embodiment.
Figure 37:
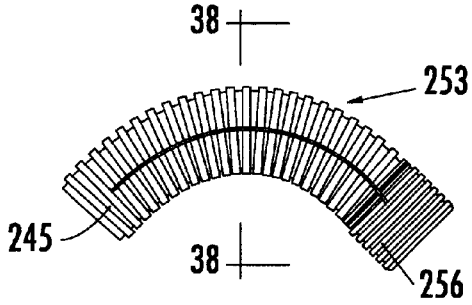
FIG. 37 is a top plan view of an alternate embodiment of FIG. 36 illustrating a male to female connection elbow pipe section.
Figure 36:
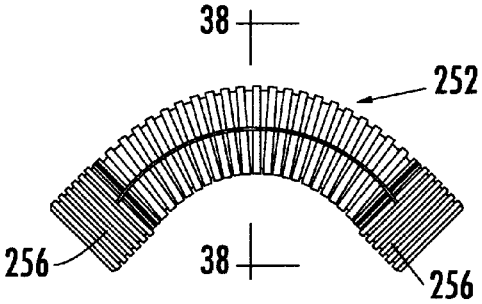
FIG. 36 is a top plan view of an alternate embodiment of the pipe section of the present invention illustrating a female to female connection elbow pipe section.
Figure 38:
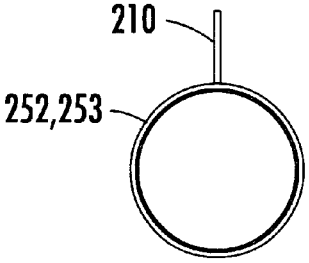
FIG. 38 is a cross-section view through lines 38—38 of FIGS. 36 and 37.

Further, and as illustrated with reference to FIG. 35, the rib 210 in alternate embodiments comprises rib sections 213 in spaced relation along the pipe section top surface 230. Such a configuration is useful when elevation changes require flexing of the pipe section 200 within the vertical plane. In addition to pipe sections 200 as earlier described, pipe section joint or elbow connections 252, 257, as illustrated with reference to FIGS. 36–38, are used in certain installations. As illustrated, elbows 252, 257 will have male 254 and female 256 end connections as demanded by the pipe section 200 or the installation desired, and as earlier described with reference to the pipe section 200, and alternate embodiments. In either case, the rib 210 is affixed as earlier described and as illustrated with reference to FIG. 38. Further, and as earlier described, a preferred embodiment of the pipe sections herein described have their rib integrally formed with the pipe conduit.

Figure 39:
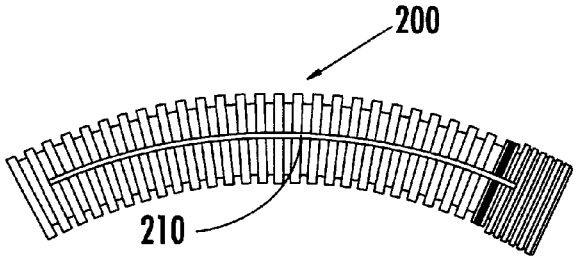
FIG. 39 is a top plan view of a pipe section of the present invention bending within a horizontal plane perpendicular to the pipe section rib.

As earlier described, the rib 210 provides sufficient rigidity to the corrugated pipe section 200 for maintaining desired elevation and grade along the pipe section 200 during the pouring of aggregate 232. The pipe section 200 does have a flexibility in a horizontal plane 259 generally perpendicular to the vertical plane 214 of the rib 200 which permits bending within the horizontal plane 259 as illustrated with reference to FIG. 39. As earlier described with reference to FIG. 13, placing devices 100 every few feet along the pipe section 200 controls the bending for holding the pipe section 200 within the desired location as described with reference to FIGS. 18 and 19 for the system 300 installation. In such an installation, a separation 340 between pipe sections of drain field 316 as well as a separation 342 from absorption bed side walls 344 is desired.

Figure 40:
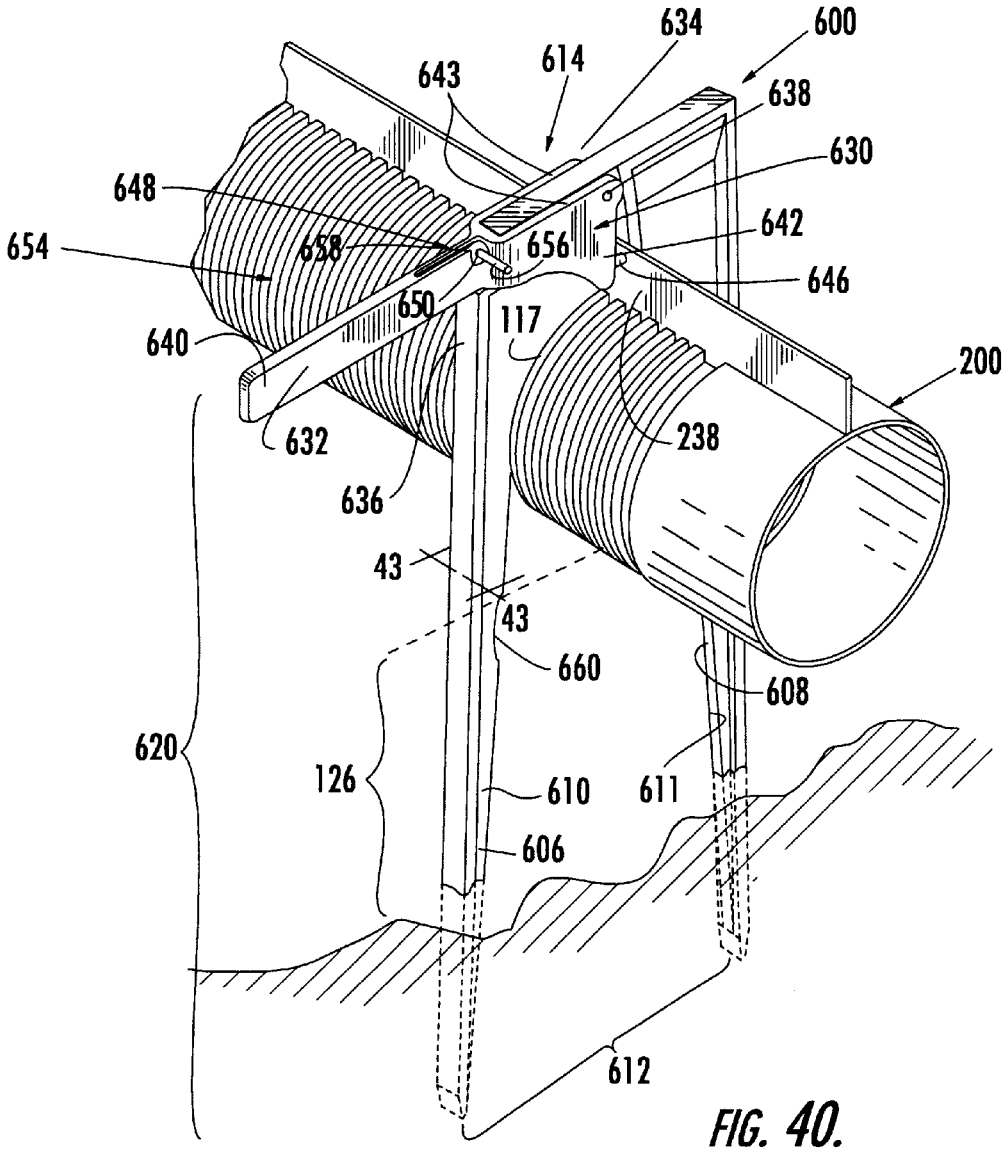
FIG. 40 is a front perspective view of an improved embodiment of the present invention.
Figure 43:
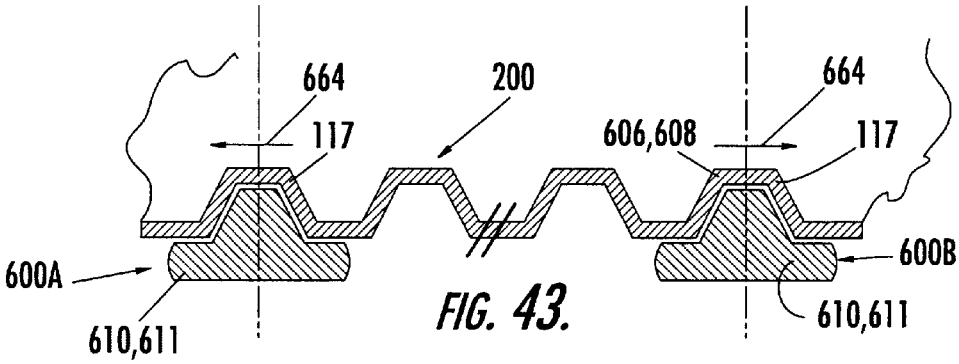
FIG. 43 is a partial cross-section taken through lines 43—43 of FIG. 40.

With reference now to FIGS. 40–44, a preferred embodiment of the present invention includes improvements to the pipe supporting device 100 above described with reference to FIGS. 1–4, and will herein be described with reference to device 600. With further reference initially to FIG. 40, the pipe supporting device 600 secures the drainfield pipe section 200 above the grade level 122 in preparation of forming aggregate around the pipe section as earlier described with reference to FIGS. 12 and 13, by way of example. For the device 600 herein described, one preferred embodiment includes metal cast structure rather than the rebar styled structure earlier described for the device 100. Elements as earlier described with reference to the device 100 are included and form a part of the present invention. The device 600 comprises a pair of elongate anchor members 610, 611 separated by dimension 612 sufficient for receiving the pipe section 200 therebetween. Each elongate member 610, 611 includes an edge 606, 608 opposing each other and each having a width dimension for being received between the corrugations 117 of the pipe section 200. Further, the opposing inside edges 606, 608 are outwardly tapered from clamping means 614 at a device proximal end 616 toward a device distal end 618. As illustrated with reference to FIG. 41, by tapering the opposing inside edges 606, 608 of the anchor members 610, 611, the pipe section 200 loosely fits between the anchor members 610, 611 at a displaced distance from clamping means 614, while being closely fit proximate the clamping means. As above described, the length 620 of the elongate anchor members 610, 611 is sufficient to penetrate the grade surface 122 to a depth 124 for holding the anchor members upright without requiring additional support while securing the pipe section 200 above the grade surface 122 at a desired height 126, as illustrated with reference again to FIG. 40.

Again with reference to FIGS. 40–42, the device 600 includes the clamping means 614 which comprises a clamp 630 having a clamp handle 632 pivotally attached at a handle distal end 634 to an anchor member upper portion 636 at the device proximal end 602, using a pivot pin 638. A handle proximal end 640 permits the handle 632 to be held for movement about the pivot pin 638. A first jaw member 642 is integrally formed as part of the distal end 634. A second jaw member 644 is integrally as part of one anchor member upper portion 636 for communicating with the first jaw member 642 in securing the rib 210 therebetween, as again illustrated with reference to FIGS. 40 and 42. In the preferred embodiment herein described with reference to FIGS. 40–42, the first jaw member 642 is in a bifurcated form which permits fork ends 643 to receive the anchor upper portion 636 therebetween, as illustrated with reference again to FIG. 40. A slot 645 is formed within a central portion of the anchor upper portion 636, which slot is dimensioned for receiving the rib 210 therein.

Figure 41:
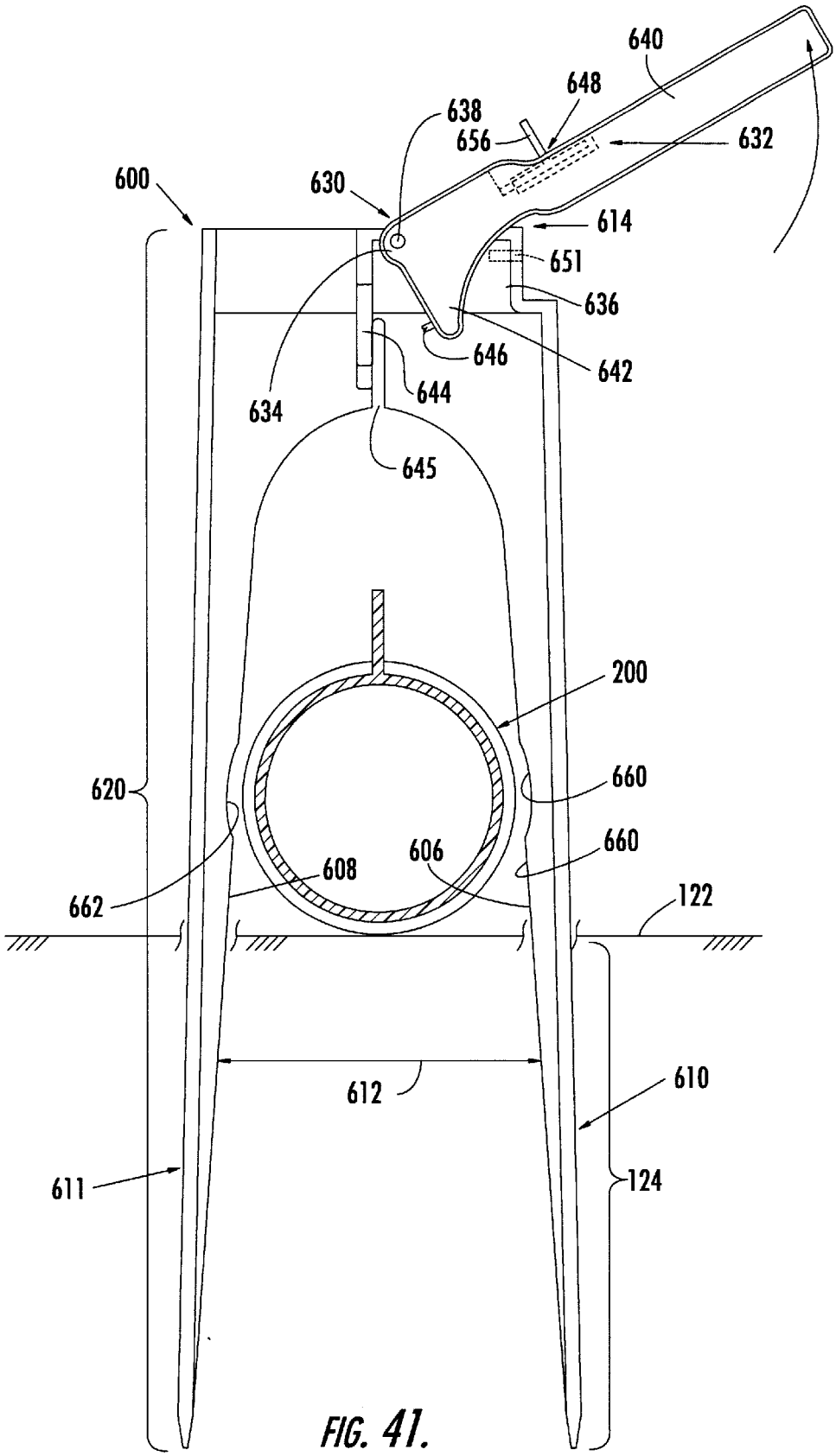
FIG. 41 is a rear elevation view of the pipe supporting device in an open clamp position, illustrating the pipe positioned for movement between elongate anchor members of the supporting device.
Figure 42:
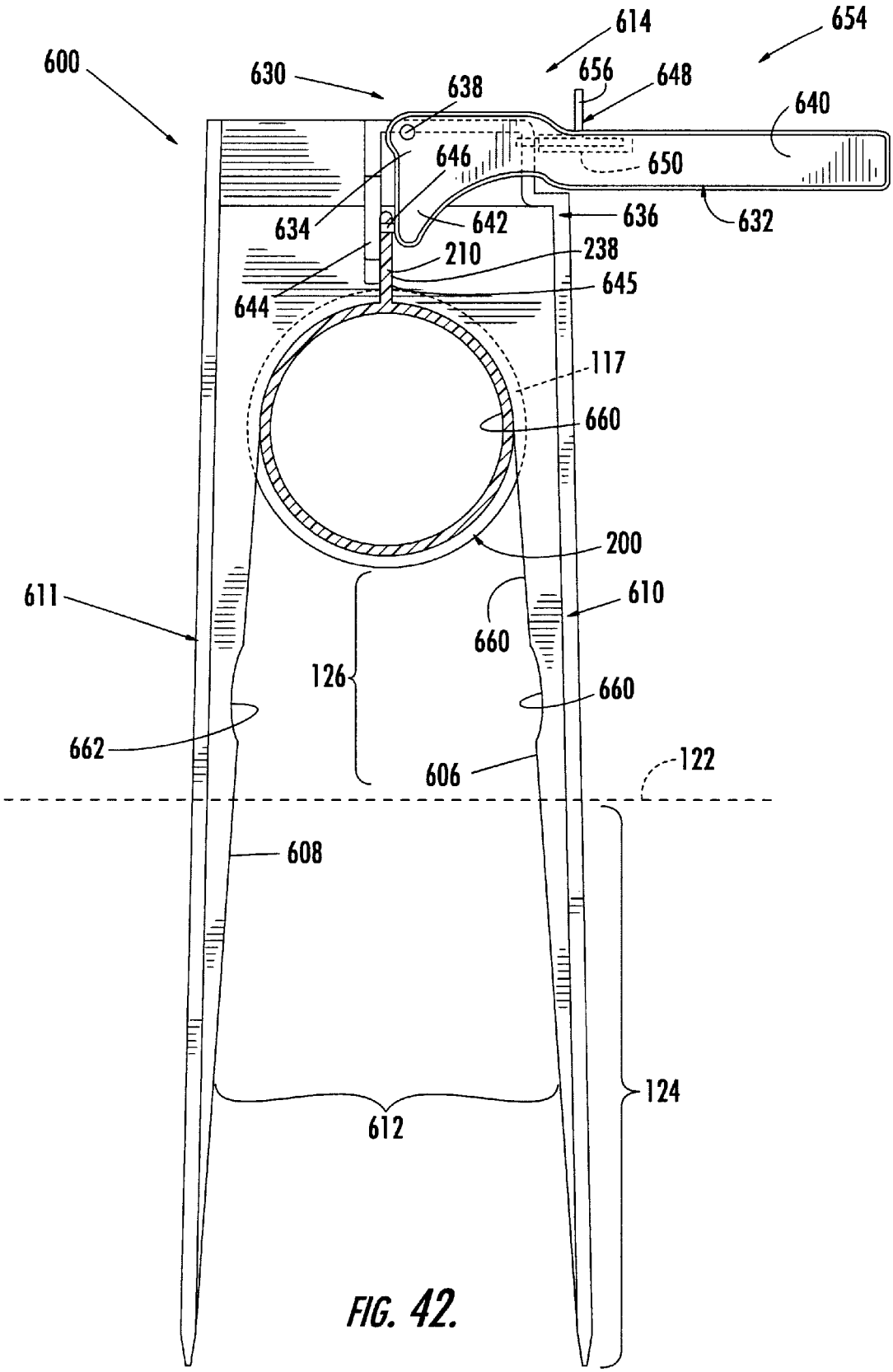
FIG. 42 is a rear elevation view of the embodiment of FIG. 40, illustrating the pipe supported by the pipe support device with the device in the clamped position.

With continued reference to FIGS. 40–42, the clamp 630 further comprises a pin pair 646 extending from a clamping surface of the first jaw 642 for penetrating the rib side wall surface 238 to enhance a frictional force between clamping surfaces of the jaws 642, 644 when securing the rib 210 therebetween and thus the pipe section 200 in the desired position above the grade surface 122. A single pin 646 is useful. However, the use of the pin pair 646 reduces pivoting action of the pipe section 200 and thus improves stiffening of the pipe section within a plane of the pipe section including the rib and axis of the pipe section. To provide further assurance of a locking of the rib 210 between the jaws 642, 644 biasing against the rib, and prevent the aggregate typically poured onto the grade surface 122 from lifting the handle away from its clamping position, a locking assembly 648 is provided which includes a locking pin 650 slidable within a channel 652 carried within the handle, as illustrated with reference again to FIG. 40. The locking pin 650 secures the handle 632 in a clamping position 654. To secure the locking pin 650, a pin arm 656 extends radially outward for rotation into a notch 658 carried within the handle 632 for receiving the pin arm 656, when the locking pin 650 is inserted into a hole 651 in the anchor member upper portion 636, as illustrated with reference again to FIG. 42, by way of example.

As above described with reference to FIGS. 13 and 15–17, multiple devices 100 (and devices 600 as herein to be understood) are used longitudinally along the pipe section 200 to support the pipe section and interconnected sections 201, as appropriate. As above described, the device 600 includes the elongate anchor members 610 particularly formed with the opposing inside edges 606, 608 for slidably fitting between adjacent corrugations 117 when the pipe 200 is fitted into the clamp means 614, as illustrated with reference again to FIGS. 40 and 42. Such a fit, as illustrated with reference to FIG. 43, allows the generally flexible pipe section 200 to be axially stretched between devices 600A, 600B when securing the pipe section, adds a tension 664 within the pipe section and thus enhances the stiffness provided by the rib 210. During one preferred installation method, the pipe section 200, or connected sections, positioned on the grade surface 122. The device 600 straddles the pipe section 200 and is manually pushed into the grade surface 122 to a depth 125 which allows a separation between the elongate anchor members 610, 61 that permits the pipe sections to be axially moved therebetween, as illustrated by way of example with reference again to FIG. 41. As a guide to the user, the inside edges 606, 608 include arcuate portions 660, 662 which further increase the separation dimension 612, allowing free axial movement of the pipe sections 200.

Accordingly, many modifications and other embodiments of the invention will come to the mind of one skilled in the art having the benefits of the teachings presented in the foregoing descriptions and the associated drawings. Therefore, it is understood that the invention is not to be limited to the specific embodiments disclosed, and that modifications and embodiments are intended to be included within the scope of the appended claims.

What is claimed is:

1. A drainfield pipe installation device for suspending a corrugated pipe above a grade level for pouring aggregate thereon, wherein the pipe includes a rib extending radially therefrom, the device comprising:

an elongate member having a proximal end for supporting a pipe section therefrom and a distal end operable with a grade surface for suspending the pipe section therefrom; and a clamp carried by the elongate member at the distal end thereof, the clamp having opposing first and second jaw members operable from a first position for receiving a top portion of the pipe section therefrom, to a second position for biasing against the top portion in a clamping arrangement.

2. The device according to claim 1, wherein the clamp comprises a handle pivotally attached to the proximal end of the elongate member, the handle having a proximal end pivotal about a pivot pin carried at a distal end of the handle, the distal end having the first jaw member carried thereby.

3. The device according to claim 2, further comprising a locking pin slidably carried by the handle for movement into and out of the elongate member proximal end, the locking pin slidable into a hole for securing the handle and thus clamping in the locking arrangement.

4. The device according to claim 2, wherein the second jaw member is integrally formed with the elongate member proximal end.

5. The device according to claim 1, wherein the first jaw member includes fork elements forming a bifurcated end pivotally attached to the elongate member proximal end and carried therebetween.

6. The device according to claim 1, wherein the elongate member comprises opposing first and second anchor members in a spaced relation for receiving the pipe section therebetween.

7. The device according to claim 6, wherein the first and second anchor members include opposing inside edges outwardly tapered from the proximal end toward the distal end thereof.

8. The device according to claim 7, wherein a first separation distance between the opposing inside edges of the first and second anchor members at the distal end thereof provide for a free longitudinal movement of the pipe section therebetween, and wherein a second separation distance at a proximal end thereof positions the opposing inside edges between corrugations of the pipe section for restricting the longitudinal movement thereof.

9. The device according to claim 8, wherein each of the opposing inside edges includes an arcuate shape transversely positioned for increasing the separation at the distal end.

10. The device according to claim 1, wherein the clamp is operable about a slot carried by the elongate member proximal end, the slot dimensioned for receiving the rib therein, and wherein the first and second jaw members secure the rib within the slot.

11. The device according to claim 10, further comprising a friction pin extending from the first jaw member for enhancing frictional contact of the jaw member with the rib when the clamp is in the clamping arrangement.

12. The device according to claim 11, wherein the friction pin comprises a pin pair for limiting rotation of the rib during the clamping arrangement.

13. A device useful in suspending a pipe, the device comprising:

an elongate member having a proximal end operable with a pipe section and a distal end operable with a grade surface for suspending the pipe section above the grade surface; and a clamp carried by the elongate member, the clamp having opposing first and second jaw members operable from a first position for receiving a rib radially extending from the pipe section, to a second position for biasing against the rib in a clamping arrangement thereof.

14. The device according to claim 13, wherein the clamp comprises a handle having at a proximal end thereof, and wherein the handle is pivotal about a pivot pin carried at a distal end thereof, the distal end having the first jaw member carried thereby.

15. The device according to claim 13, further comprising a locking pin slidably carried by the clamp, the locking pin operable with the elongate member proximal end for securing the clamp in the locking arrangement.

16. The device according to claim 13, wherein the second jaw member is integrally formed with the elongate member proximal end.

17. The device according to claim 13, wherein the first jaw member includes fork elements forming a bifurcated end pivotally attached to the elongate member proximal end and carried therebetween.

18. The device according to claim 13, wherein the elongate member comprises opposing first and second anchor members in a spaced relation for receiving the pipe section therebetween.

19. The device according to claim 18, wherein the first and second anchor members include opposing inside edges outwardly tapered from the proximal end toward the distal end thereof.

20. The device according to claim 19, wherein a first separation distance between the opposing inside edges of the first and second anchor members at the distal end thereof provide for a free longitudinal movement of the pipe section therebetween, and wherein a second separation distance at a proximal end thereof positions the opposing inside edges between corrugations of the pipe section for restricting the longitudinal movement thereof.

21. The device according to claim 20, wherein each of the opposing inside edges includes an arcuate shape transversely positioned for increasing the separation at the distal end.

22. The device according to claim 13, wherein the clamp is operable about a slot carried by the elongate member proximal end, the slot dimensioned for receiving the rib therein, and wherein the first and second jaw members secure the rib within the slot.

23. The device according to claim 22, further comprising a friction pin extending from the first jaw member for enhancing frictional contact of the first jaw member with the rib when the clamp is in the clamping arrangement.

24. A device useful in suspending a pipe, the device comprising:

an elongate member having a proximal end operable with a pipe section and a distal end for penetrating a grade surface for supporting the pipe section in a spaced relation to the grade surface; and clamping means for clamping the pipe section to the elongate member, the clamping means operable from a first position for receiving a rib radially extending from the pipe section, to a second position for biasing against the rib in a clamping arrangement thereof.

25. The device according to claim 24, wherein the clamping means comprise:

first and second jaw members; and a handle having at a proximal end for gripping thereof, and a distal end having the second jaw member carried thereby, and wherein the handle is pivotal about the proximal end of the elongate member.

26. The device according to claim 24, further comprising a locking pin slidably carried by the clamping means, the locking pin operable with the elongate member proximal end for securing the clamping means in the locking arrangement.

27. The device according to claim 24, wherein the elongate member comprises opposing first and second anchor members in a spaced relation for receiving the pipe section therebetween.

28. The device according to claim 27, wherein the first and second anchor members include opposing inside edges outwardly tapered from a proximal end toward a distal end thereof.

29. The device according to claim 28, wherein each of the opposing inside edges includes an arcuate shape transversely positioned for increasing a separation distance between the opposing inside edges, the separation distance sufficient for providing a longitudinal slidable movement of the pipe section carried therebetween.

30. The device according to claim 24, wherein the clamping means is operable with a slot carried by the elongate member proximal end, the slot dimensioned for receiving the rib therein, and wherein the clamping means secures the rib within the slot.

* * * * *